US009001015B2

(12) United States Patent
Kitagawa et al.

(10) Patent No.: US 9,001,015 B2
(45) Date of Patent: Apr. 7, 2015

(54) LIQUID CRYSTAL DISPLAY DEVICE, DISPLAY METHOD, DISPLAY PROGRAM, AND COMPUTER READABLE RECORDING MEDIUM

(75) Inventors: Daiji Kitagawa, Osaka (JP); Kouji Kumada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 353 days.

(21) Appl. No.: 13/578,636

(22) PCT Filed: Feb. 15, 2011

(86) PCT No.: PCT/JP2011/053168

§ 371 (c)(1),
(2), (4) Date: Aug. 13, 2012

(87) PCT Pub. No.: WO2011/102349

PCT Pub. Date: Aug. 25, 2011

(65) Prior Publication Data

US 2012/0306835 A1 Dec. 6, 2012

(30) Foreign Application Priority Data

Feb. 19, 2010 (JP) ..... 2010-034981

(51) Int. Cl.
*G09G 3/36* (2006.01)

(52) U.S. Cl.
CPC ..... *G09G 3/3648* (2013.01); *G09G 3/3614* (2013.01); *G09G 3/3655* (2013.01); *G09G 2300/0823* (2013.01); *G09G 2300/0857* (2013.01); *G09G 2330/021* (2013.01)

(58) Field of Classification Search
CPC ..... G09G 3/36; G09G 3/3611–3/3618; G09G 3/3648–3/3696; G09G 2300/0823; G09G 2300/0842–2300/0866; G09G 2330/021; G09G 2330/022
USPC ..... 345/208–213, 87, 90–92, 94–99
See application file for complete search history.

(56) References Cited

U.S. PATENT DOCUMENTS

| | | | | |
|---|---|---|---|---|
| 5,712,652 | A | 1/1998 | Sato et al. | |
| 2002/0067327 | A1* | 6/2002 | Ozawa et al. | 345/89 |
| 2008/0238850 | A1 | 10/2008 | Watanabe | |
| 2009/0322731 | A1 | 12/2009 | Yasuda | |

FOREIGN PATENT DOCUMENTS

| | | | |
|---|---|---|---|
| JP | 04-050997 | A | 2/1992 |
| JP | 2000-221956 | A | 8/2000 |

(Continued)

OTHER PUBLICATIONS

Official Communication issued in International Patent Application No. PCT/JP2011/053168, mailed on Mar. 22, 2011.

*Primary Examiner* — Nathan Danielsen
(74) *Attorney, Agent, or Firm* — Keating & Bennett, LLP

(57) ABSTRACT

The liquid crystal display device (1) includes a liquid crystal panel (69) having, for each of pixels (60), a digital memory element (68) for holding an electric potential according to image data and a liquid crystal cell (64) for displaying an image by receiving the electric potential from the digital memory element (68); and a liquid crystal driver circuit (10) having an AC control section (22) for reversing a polarity of an AC voltage applied to the liquid crystal cell (64) on a given cycle and an image transmission control section (21) for issuing instruction on outputting of image data to the liquid crystal panel (69). In a case where an image data transmission period contains a period during which a voltage in the liquid crystal cell (64) is reversed in response to a polarity reversal of the AC voltage applied to the liquid crystal cell (64), the image transmission control section (21) causes image data to be outputted to the liquid crystal panel (69) after the polarity reversal of the voltage in the liquid crystal cell (64) is completed. This makes it possible to (i) prevent a decrease in reliability of liquid crystal, (ii) update, without rewriting data, an image to be displayed, and (iii) prevent a deterioration in quality of a displayed image.

4 Claims, 11 Drawing Sheets

(56) References Cited

FOREIGN PATENT DOCUMENTS

| | | | |
|---|---|---|---|
| JP | 2003-177717 | A | 6/2003 |
| JP | 2003-222902 | A | 8/2003 |
| JP | 2004-013124 | A | 1/2004 |
| JP | 2005-018088 | A | 1/2005 |
| JP | 2008-241832 | A | 10/2008 |
| JP | 2009-063644 | A | 3/2009 |
| JP | 2009-229850 | A | 10/2009 |
| JP | 2010-008538 | A | 1/2010 |

* cited by examiner

LIQUID CRYSTAL DISPLAY DEVICE, DISPLAY METHOD, DISPLAY PROGRAM, AND COMPUTER READABLE RECORDING MEDIUM

TECHNICAL FIELD

The present invention relates to a liquid crystal display device, etc. for updating a displayed image without rewriting data.

BACKGROUND ART

Conventionally, a liquid crystal display device has been developed which has a standby mode for driving the liquid crystal display device with low power consumption. In the standby mode, when a display is temporarily unnecessary, the liquid crystal display device enters into a standby state in which the display is turned OFF, and then, once the display is required, the standby state is cancelled and the liquid crystal display device again carries out a normal display.

In such a standby mode, while the display is not required, circuits (such as a data generator, a timing generating circuit, and a control signal generating circuit) in a driver are controlled to be in a resting state. This prevents the driver from consuming electric power.

However, in a case where a current-alternating signal is also stopped while a liquid crystal driving voltage is being applied, the liquid crystal is driven by a direct current. This causes a significant decrease in reliability of liquid crystal.

As a measure for dealing with such a phenomenon, Patent Literature 1 discloses a circuit which carries out an AC driving of liquid crystal even during a standby mode.

FIG. 9 illustrates a configuration of a liquid crystal display control circuit disclosed in Patent Literature 1.

A timing generating circuit 102 generates a basic timing based on a CK which is a basic clock input. A control signal generating circuit 103 generates signals, which are required for controlling a liquid crystal display (LCD), such as YD (scanning start pulse for Y driver), WF (current-alternating signal), LP (latching pulse for X driver and shift clock for Y driver), and XSCL (shift clock for X driver). A selector 105 supplies an A-input to Y when a select input S is at an "H" level, and supplies a B-input to the Y when the select input S is at an "L" level.

An oscillating circuit 107 generates a clock oscillating at a low frequency. A frequency dividing circuit 104 further divides the frequency of the clock generated by the oscillating circuit 107.

When entering into the standby mode, STNBY becomes the "L" level, and an output of an AND gate 106 is fixed at the "L" level. This causes the timing generating circuit 102, the control signal generating circuit 103, and a data generator 101 to be in the resting state.

On the other hand, in a case where a select input S is at the "L" level, the B-input is selected, and a signal 113 is supplied to the WF and the LP. That is, in the standby mode, the low frequency clock generated by the oscillating circuit 107 is supplied, as the signal 113, to the selector 105 via the frequency dividing circuit 104. In response to the signal 113 thus supplied, the selector 105 outputs (i) an LP for deselecting all Y drivers and (ii) a WF required for driving the liquid crystal by alternating currents.

As such, in the standby mode, (i) the timing generating circuit 102 and the control signal generating circuit 103 are controlled to be in the resting state and (ii) the WF and the LP can be supplied to the LCD by use of the low frequency clock.

This allows (i) a reduction in power consumption and (ii) prevention of the LCD from being driven by a direct current.

In recent years, a display device has been known in which memory circuits (hereinafter, referred to as "pixel memory") are provided for respective pixels so that respective pieces of image data are stored in the pixel memories. This allows a still image to be displayed without continuously supplying image data from outside, and therefore the still image can be displayed with low power consumption.

For example, Patent Literature 2 discloses a display device including such a pixel memory.

FIG. 10 illustrates a configuration of a display device of Patent Literature 2, which includes a pixel memory.

The display device includes an X address scanning line driver 218, a digital data driver 219, and an analog data driver 220. Further, the display device is switchable between a digital data image display mode and an analog data image display mode.

In the digital data image display mode, an X address signal line 204-*n* (n is a natural number) connected with a pixel, into which image data is to be written, is selected, and a digital data signal, which has been supplied to a first switch element 208 of the pixel from a corresponding first display control line 1-*n*, is written into a digital memory element 250 made up of an NAND circuit 251 and a clocked inverter element 253. At that time, the digital memory element 250 has been made active by a signal supplied via a display mode control line 215.

The digital memory element 250 has (i) an input which is connected with a second switch element 209 and (ii) an output connected with a third switch element 210. With the configuration, any one of the second switch element 209 and the third switch element 210 becomes conductive depending on High/Low of the digital data signal. A white display reference voltage is supplied to one of a second display control line 202-*n* and a third display control line 203, and a black display reference voltage is supplied to the other. A white voltage or a black voltage, which is determined by a conductive one of the second switch element 209 and the third switch element 210, is applied to a liquid crystal cell 206.

The liquid crystal cell 206 maintains a display state based on the digital data signal, which has been stored in the digital memory element 250, until the first switch element 208 becomes conductive again and a new digital data signal is written into the digital memory element 250.

Further, at least one of the black display reference voltage and the white display reference voltage is an AC voltage whose polarity is reversed for each predetermined period. This prevents a decrease in reliability of the liquid crystal cell 206.

CITATION LIST

Patent Literature

[Patent Literature 1]

Japanese Patent Application Publication Tokukaihei No. 4-50997 A (Publication date: Feb. 19, 1992)

[Patent Literature 2]

Japanese Patent Application Publication Tokukai No. 2003-177717 A (Publication date: Jun. 27, 2003)

[Patent Literature 3]

Japanese Patent Application Publication Tokukai No. 2009-229850 A (Publication date: Oct. 8, 2009)

[Patent Literature 4]

Japanese Patent Application Publication Tokukai No. 2009-63644 A (Publication date: Mar. 26, 2009)

SUMMARY OF INVENTION

Technical Problem

In a case where a still image is displayed by the liquid crystal display device in which the pixel memories are provided for the respective pixels, it is not necessary to keep supplying the still image to the pixels (i.e., not necessary to keep scanning), unlike a liquid crystal display device having no pixel memory. That is, in a case where an identical image is displayed by the liquid crystal display device in which the pixel memories are provided for the respective pixels, it is not necessary to rewrite the identical image into the pixels, whereas, in a case where a different image is to be displayed, the different image is written into the pixels.

However, even in the liquid crystal display device having the pixel memories, it is necessary to carry out a COM reversal operation in which positive and negative voltages (hereinafter, sometimes referred to as "COM signal") are alternately applied to liquid crystal in each pixel, in order to secure reliability of the liquid crystal.

In general, in a liquid crystal display device having no pixel memory, a timing at which an image is transmitted to a liquid crystal display panel is synchronized with a timing at which a COM reversal operation is carried out. In the liquid crystal display device having no pixel memory, therefore, a COM reversal operation is not generally carried out while an image is being written into the pixels.

On the other hand, in the liquid crystal display device having the pixel memory, image data is transmitted only when an image to be displayed is changed. Therefore, a timing at which an image is transmitted is not synchronized with a timing at which a COM reversal operation is carried out.

Under the circumstances, in a case where the liquid crystal display device having the pixel memory carries out the COM reversal operation on a given cycle, the COM reversal operation is sometimes carried out during a writing of an image (see FIG. 11).

FIG. 11 is an explanatory view for explaining a timing of an image writing period and a timing of a COM reversal operation.

In a case where a COM signal is reversed in the image writing period, an image writing is sometimes not normally carried out due to a factor such as a voltage drop caused by a large current flowing across the circuit when the COM signal is reversed.

The present invention is accomplished in view of the problem, and its object is to provide a liquid crystal display device which can (i) prevent a decrease in reliability of liquid crystal, (ii) update, without rewriting data, an image to be displayed, and (iii) prevent a deterioration in quality of a displayed image.

Solution to Problem

In order to attain the object, a liquid crystal display device of the present invention includes: a liquid crystal panel in which a plurality of pixels for displaying an image are arranged; and a driving circuit for supplying an image signal to the liquid crystal panel so that the liquid crystal panel displays the image, each of the plurality of pixels having: a storage element for holding an electric potential which varies depending on an image signal supplied from the driving circuit, and a display element to which a voltage for displaying the image is applied by the electric potential being supplied to the display element, the driving circuit including: polarity reversal instruction means for causing an AC voltage, which is applied across the display element, to be subjected to a polarity reversal, and image signal output instruction means for issuing an instruction on supplying the image signal to the liquid crystal panel, in a case where the image signal output instruction means determines that a polarity reversal period is contained in an image transmission period, the image signal output instruction means carries out the instruction on supplying the image signal to the liquid crystal panel after a polarity reversal of the voltage is completed, during the image transmission period, a change in the voltage, which is supplied from the storage element to the display element, (i) being initiated in response to the image signal being supplied to the liquid crystal panel and (ii) being then completed, during the polarity reversal period, the voltage applied across the display element being subjected to a polarity reversal in response to a polarity reversal of the AC voltage.

In order to attain the object, a display method of the present invention includes a driving method, in which driving method a liquid crystal panel displays an image by supplying an image signal to the liquid crystal panel in which a plurality of pixels for displaying the image are arranged, each of the plurality of pixels having: a storage element for holding an electric potential which varies depending on an image signal supplied from the driving circuit, and a display element to which a voltage for displaying the image is applied by the electric potential being supplied to the display element, the display method including the steps of: (i) causing an AC voltage, which is applied across the display element, to be subjected to a polarity reversal, and (ii) issuing an instruction on supplying the image signal to the liquid crystal panel, in a case where it is determined, in the step (ii), that a polarity reversal period is contained in an image transmission period, the instruction on supplying the image signal to the liquid crystal panel is carried out after a polarity reversal of the voltage is completed, during the image transmission period, a change in the voltage, which is supplied from the storage element to the display element, (a) being initiated in response to the image signal being supplied to the liquid crystal panel and (b) being then completed, during the polarity reversal period, the voltage applied across the display element being subjected to a polarity reversal in response to a polarity reversal of the AC voltage.

According to the configuration, each of the plurality of pixels has (i) the storage element for holding an electric potential which varies depending on an image signal supplied from the driving circuit and (ii) the display element to which the voltage for displaying the image is applied by the electric potential being supplied to the display element. With the configuration, in a case where an identical image is displayed, it is not necessary to renew the electric potential held by the storage element. Hence, in a case where the identical image is continuously displayed, the liquid crystal panel does not need to read another image signal. This allows a reduction in electric power consumed by the liquid crystal panel.

Moreover, according to the configuration, the polarity reversal instruction means causes the AC voltage, which is applied to the display element, to be subjected to the polarity reversal on a given cycle. This makes it possible to (i) prevent a DC voltage from being applied to the display element and (ii) prevent a decrease in reliability of the display element.

Moreover, according to the configuration, in a case where the image signal output instruction means determines that the polarity reversal period, during which the voltage applied across the display element is being subjected to a polarity reversal in response to the polarity reversal of the AC voltage, is contained in the image transmission period during which a polarity reversal of the voltage, which is supplied from the storage element to the display element, (i) is initiated in response to the image signal being supplied to the liquid crystal panel and (ii) is then completed, the image signal output instruction means carries out the instruction on supplying the image signal to the liquid crystal panel after the polarity reversal of the voltage is completed.

This makes it possible to prevent the AC voltage, applied across the display element, from being subjected to a polarity reversal during the image transmission period. As such, it is possible to prevent an electric potential, which is held by the storage element of each of the plurality of pixels, from changing abnormally. This allows prevention of a deterioration in quality of a displayed image.

Advantageous Effects of Invention

The liquid crystal display device of the present invention includes: a liquid crystal panel in which a plurality of pixels for displaying an image are arranged; and a driving circuit for supplying an image signal to the liquid crystal panel so that the liquid crystal panel displays the image, each of the plurality of pixels having: a storage element for holding an electric potential which varies depending on an image signal supplied from the driving circuit, and a display element to which a voltage for displaying the image is applied by the electric potential being supplied to the display element, the driving circuit including: polarity reversal instruction means for causing an AC voltage, which is applied across the display element, to be subjected to a polarity reversal, and image signal output instruction means for issuing an instruction on supplying the image signal to the liquid crystal panel, in a case where the image signal output instruction means determines that a polarity reversal period is contained in an image transmission period, the image signal output instruction means carries out the instruction on supplying the image signal to the liquid crystal panel after a polarity reversal of the voltage is completed, during the image transmission period, a change in the voltage, which is supplied from the storage element to the display element, (i) being initiated in response to the image signal being supplied to the liquid crystal panel and (ii) being then completed, during the polarity reversal period, the voltage applied across the display element being subjected to a polarity reversal in response to a polarity reversal of the AC voltage.

The display method of the present invention is a method in which a liquid crystal panel displays an image by supplying an image signal to the liquid crystal panel in which a plurality of pixels for displaying the image are arranged, each of the plurality of pixels having: a storage element for holding an electric potential which varies depending on an image signal supplied from the driving circuit, and a display element to which a voltage for displaying the image is applied by the electric potential being supplied to the display element, the display method including the steps of: (i) causing an AC voltage, which is applied across the display element, to be subjected to a polarity reversal, and (ii) issuing an instruction on supplying the image signal to the liquid crystal panel, in a case where it is determined, in the step (ii), that a polarity reversal period is contained in an image transmission period, the instruction on supplying the image signal to the liquid crystal panel is carried out after a polarity reversal of the voltage is completed, during the image transmission period, a change in the voltage, which is supplied from the storage element to the display element, (a) being initiated in response to the image signal being supplied to the liquid crystal panel and (b) being then completed, during the polarity reversal period, the voltage applied across the display element being subjected to a polarity reversal in response to a polarity reversal of the AC voltage.

This brings about effects of (i) preventing a decrease in reliability of liquid crystal, (ii) updating, without rewriting data, an image to be displayed, and (iii) preventing a deterioration in quality of a displayed image.

BRIEF DESCRIPTION OF DRAWINGS

FIG. 1 is a block diagram illustrating a configuration of a liquid crystal display device of the present invention.

FIG. 2 is a circuit diagram illustrating an example configuration of a liquid crystal panel included in a liquid crystal display device of the present invention.

FIG. 3 is a circuit diagram illustrating a circuit configuration of a liquid crystal display device of the present invention.

FIG. 4 illustrates a relation between a scanning signal and an output voltage of a digital memory element, which relation is obtained when a data signal supplied via a data signal line is latched by the digital memory element when the scanning signal is supplied via a scanning signal line.

Figure 5:
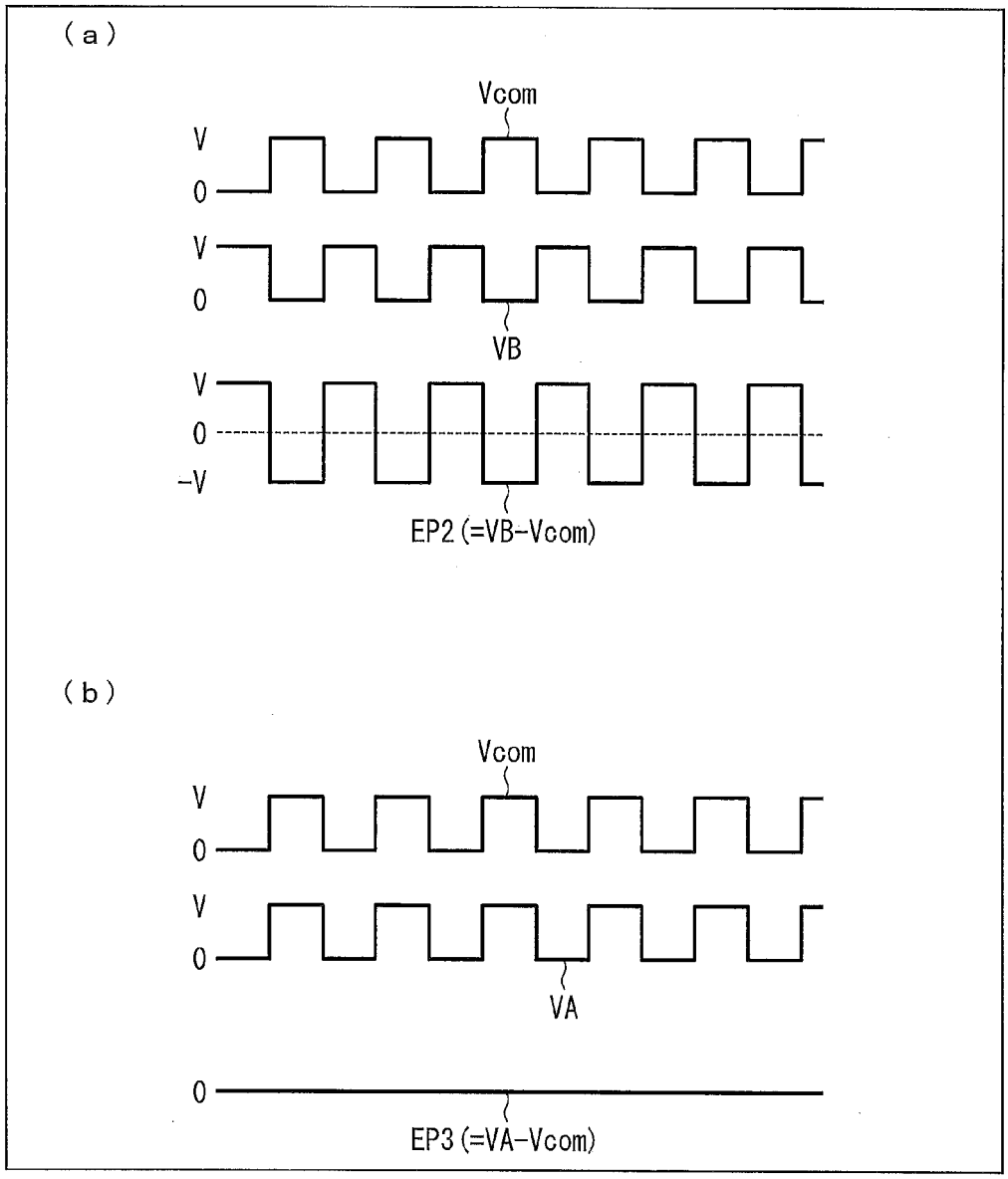
FIG. 5

Each of (a) and (b) of FIG. 5 illustrates an example of a relation between an output voltage of a digital memory element and a voltage applied across a liquid crystal cell.

FIG. 6

Figure 6:
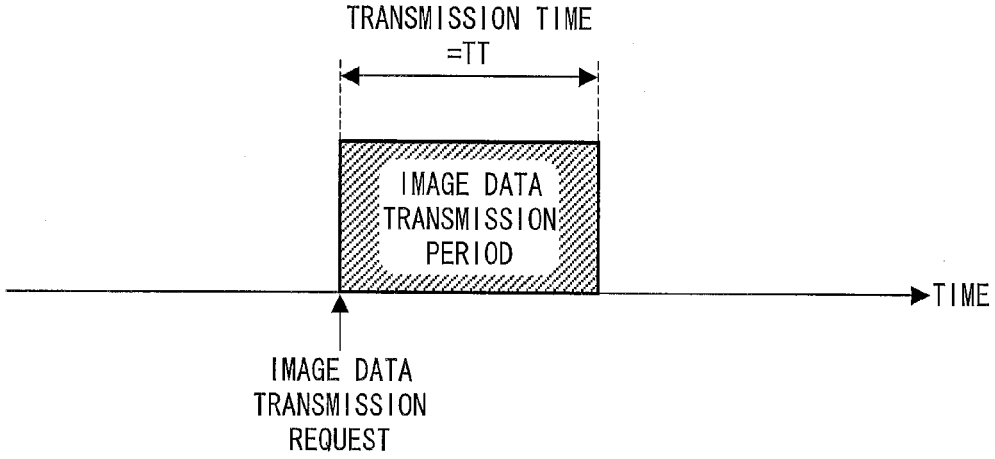

FIG. 6 illustrates a period during which image data is being transmitted.

FIG. 7

Figure 7:
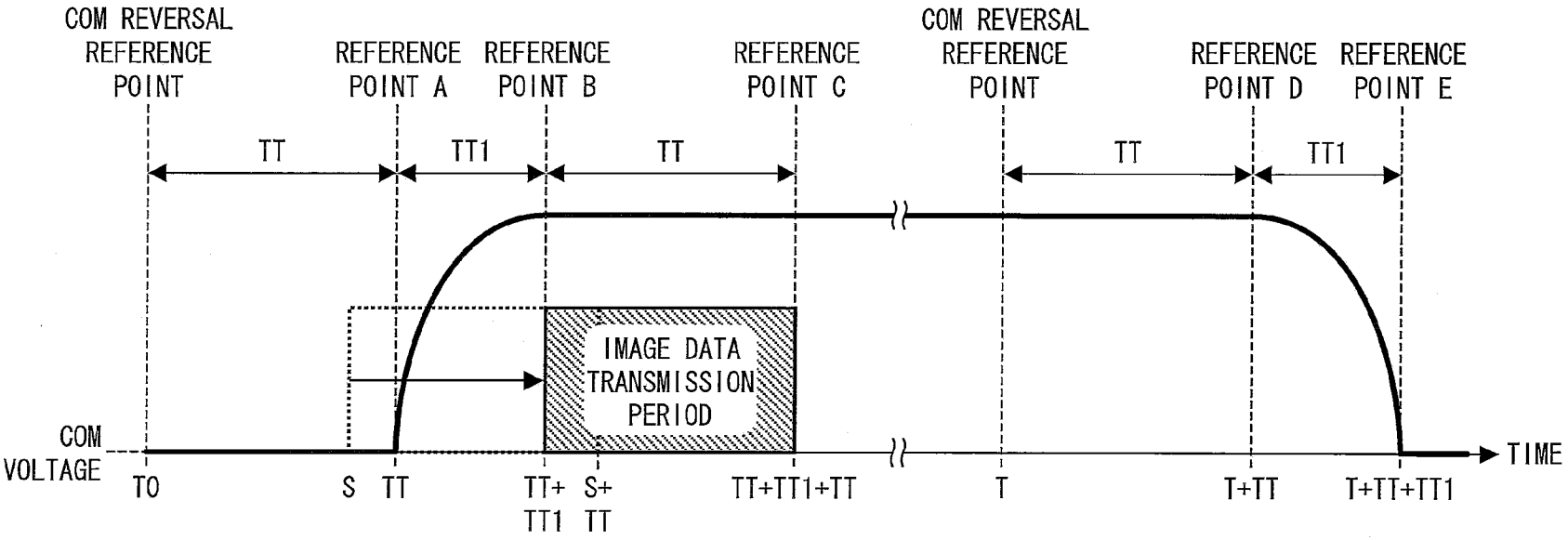

FIG. 7 illustrates a relation between an output voltage Vcom, which is an AC voltage, and a period during which image data is being transmitted.

FIG. 8

Figure 8:
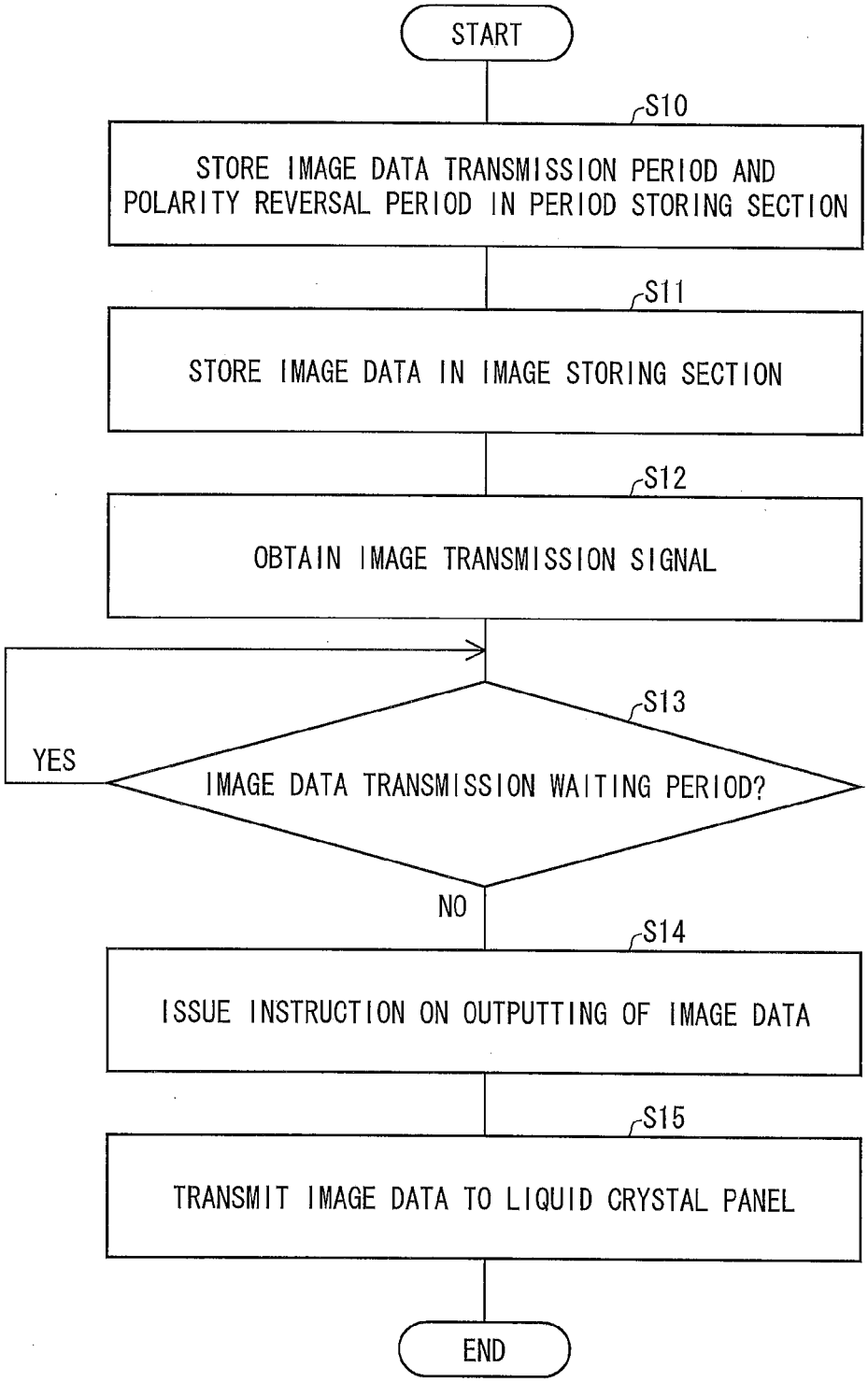

FIG. 8 illustrates a flow of processes carried out in a liquid crystal display device of the present invention.

FIG. 9

Figure 9:
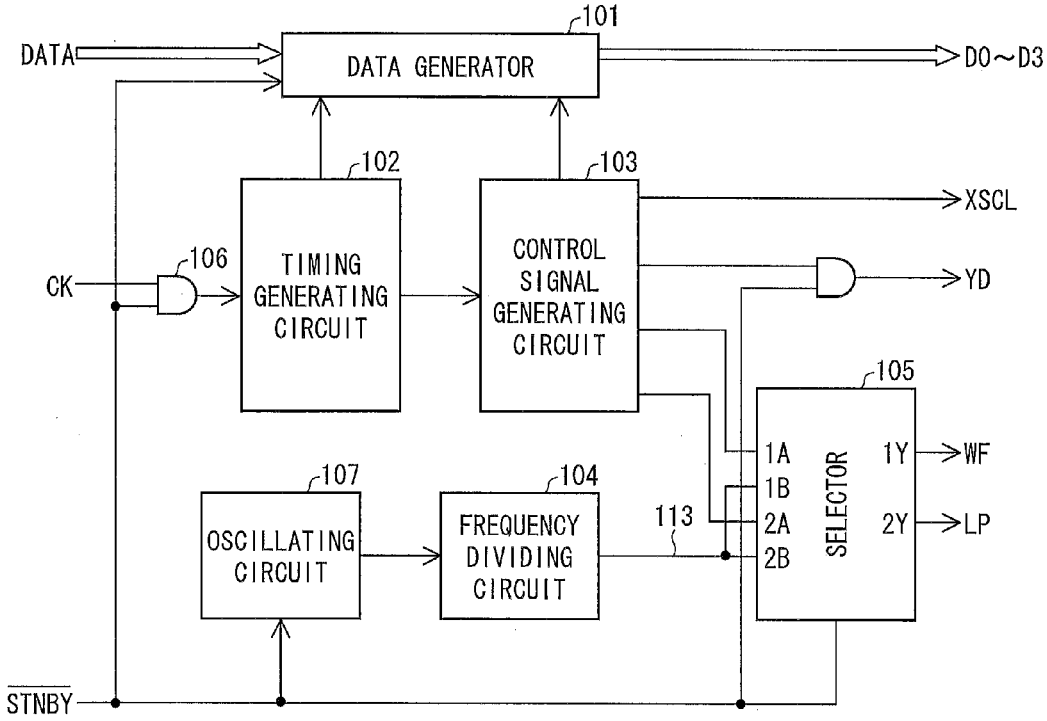

FIG. 9 illustrates a configuration of a conventional liquid crystal display control circuit.

FIG. 10

Figure 10:
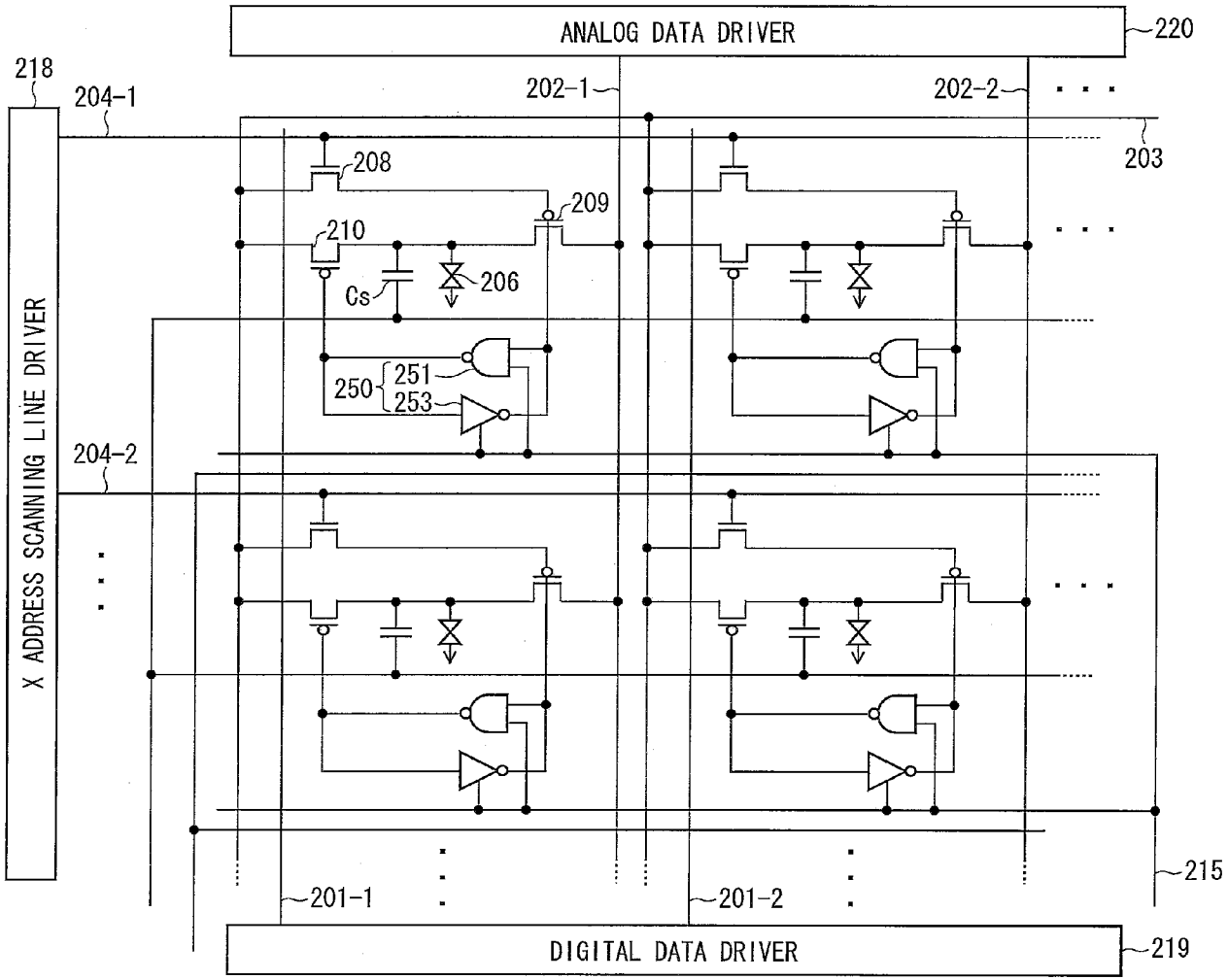

FIG. 10 illustrates a configuration of a conventional display device including a pixel memory.

FIG. 11

Figure 11:
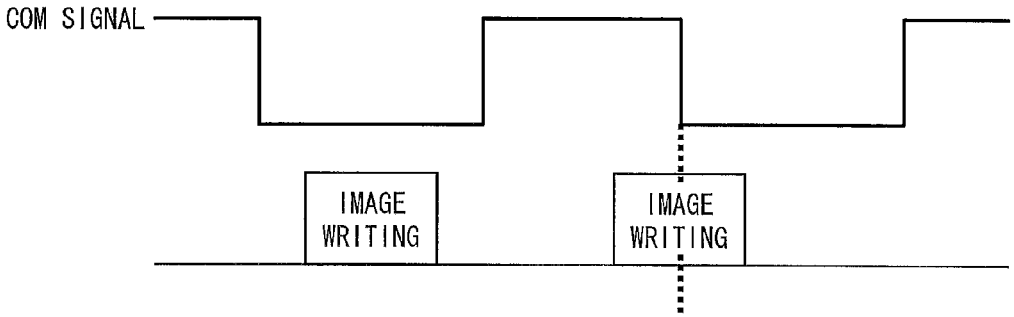

FIG. 11 is an explanatory view for explaining a timing of an image writing period and a timing of a COM reversal operation, in a conventional display device including a pixel memory.

DESCRIPTION OF EMBODIMENTS (Configuration of Liquid Crystal Panel Including Pixel Memory)

Figure 2:
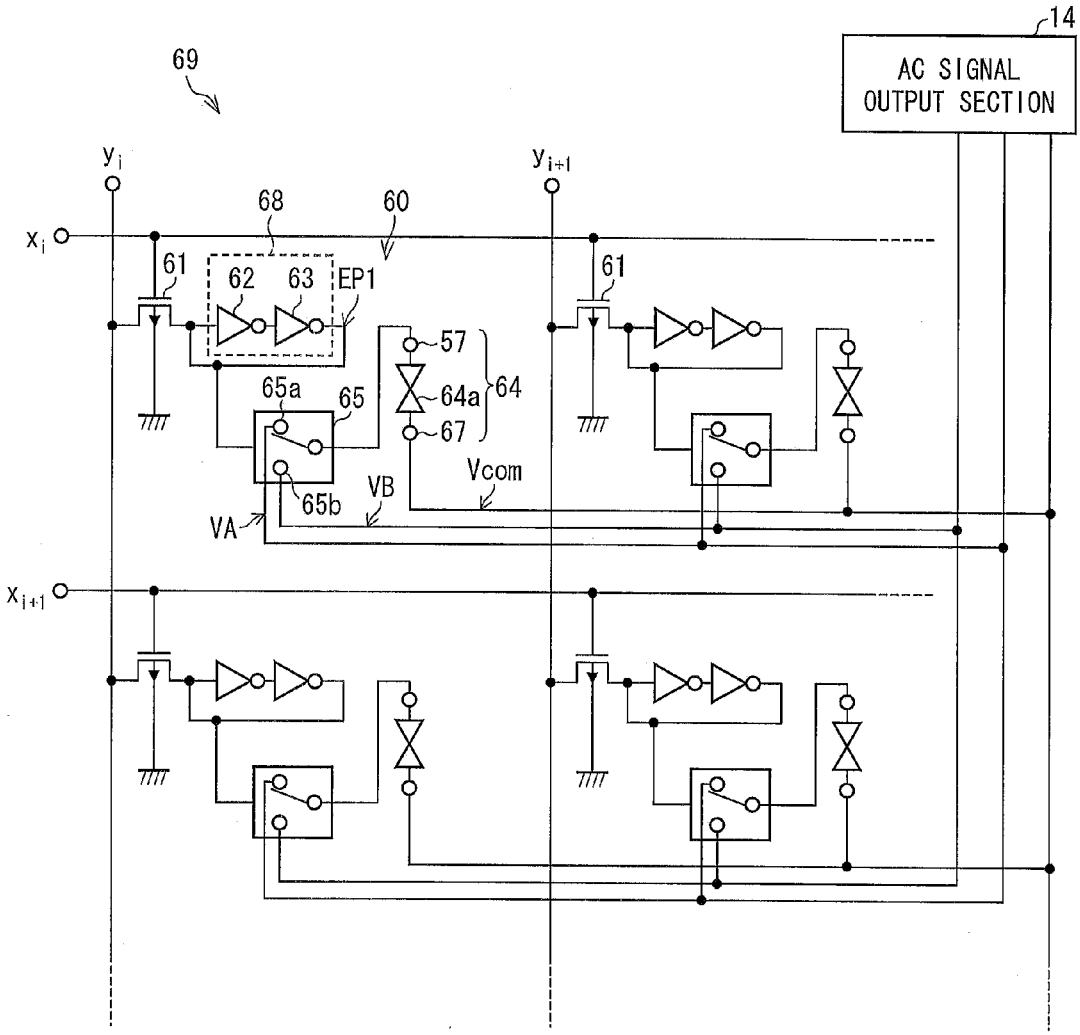
FIG. 2
Figure 3:
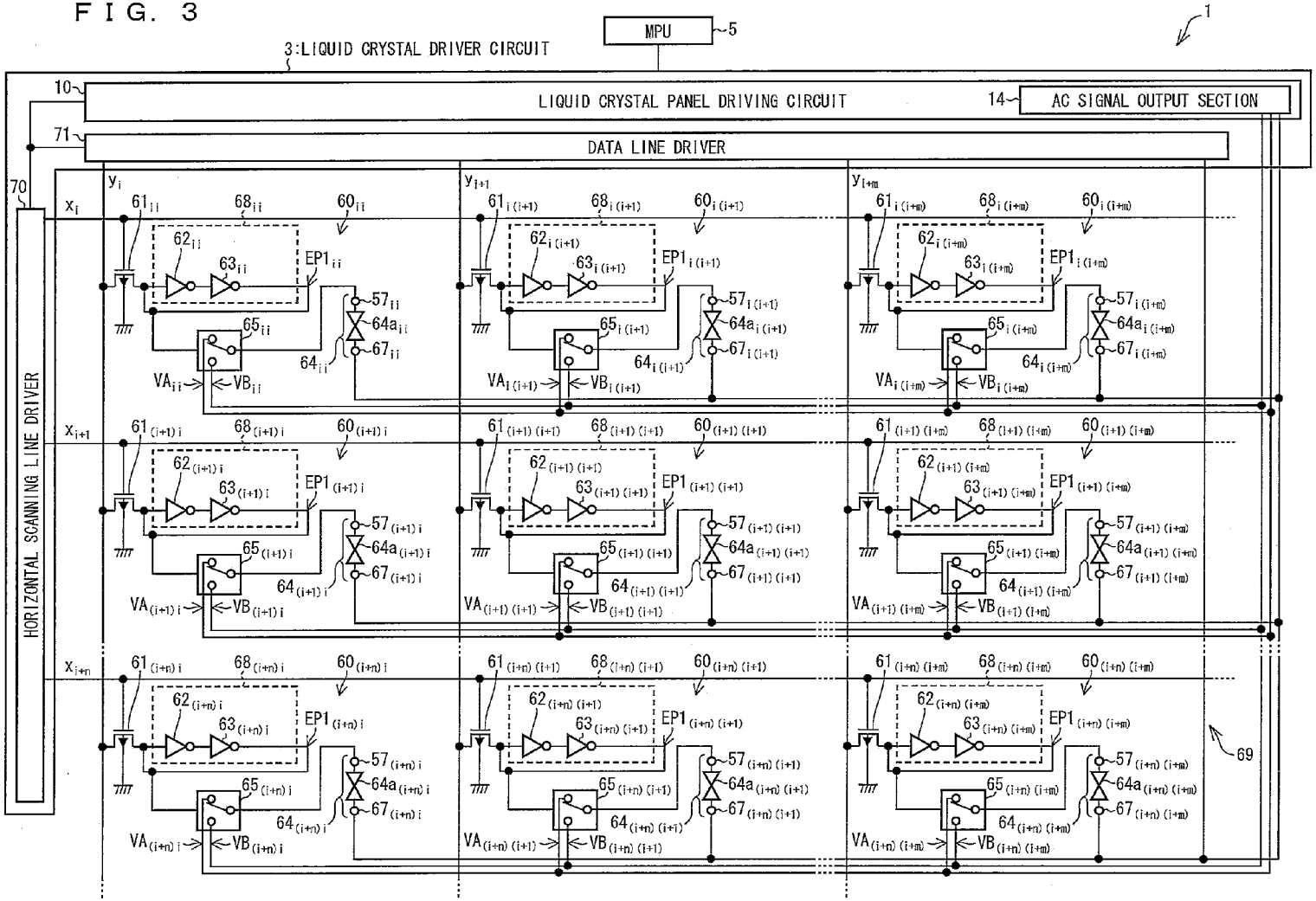
FIG. 3

The following description will discuss, with reference to FIGS. 2 and 3, (i) a configuration of a liquid crystal panel including a pixel memory and (ii) a configuration of a liquid crystal display device including the liquid crystal panel.

The liquid crystal panel including the pixel memory can keep displaying an image by causing digital memory elements, provided for respective pixels, to hold their output voltages, even after a stoppage of supplying of signals to data signal lines and scanning signal lines. Note that, although the following description will discuss a case of a normally white mode, a normally black mode can be employed instead of the normally white mode. Note that High level or Low level of each output voltage in a normally black mode corresponds to Low level or High level in the normally white mode, respectively.

FIG. 2 is a circuit diagram illustrating an example configuration of a liquid crystal panel 69 including a pixel memory.

The liquid crystal panel 69 has a plurality of pixels 60 for displaying an image, which plurality of pixels 60 are arranged in a matrix manner (see FIG. 2). In each of the plurality of pixels 60, there are provided (i) a pixel section switch element 61 such as an MOS FET, (ii) digital memory elements 62 and 63 such as inverter circuits, (iii) a liquid crystal cell (display element) 64 which is a liquid crystal capacitor, and (iv) a switch 65 having terminals 65*a* and 65*b*. Note that, hereinafter, the digital memory elements 62 and 63 are collectively referred to as "digital memory element (storage element) 68".

The digital memory element 68 holds an electric potential which varies depending on image data (image signal) supplied from a liquid crystal driver circuit 3 (later described). The liquid crystal cell 64 is made up of (i) a pixel electrode 57, (ii) a common electrode 67 facing the pixel electrode 57, and (iii) a liquid crystal 64*a* provided between the pixel electrode 57 and the common electrode 67. The pixel electrode 57 of the liquid crystal cell 64 is connected with the digital memory element 68 via the switch 65. The common electrode 67 (COM) of the liquid crystal cell 64 is connected with an AC signal output section 14 (later described). When an electric potential held by the digital memory element 68 is supplied to the liquid crystal cell 64, a voltage for displaying an image is applied across the liquid crystal cell 64. The image is thus displayed.

The liquid crystal cell 64 carries out an AC driving in response to AC voltages (output voltages Vcom, VA, and VB) supplied from the AC signal output section 14 (later described). An output voltage Vcom (COM signal), whose polarity (High level or Low level) is periodically reversed, is supplied from the AC signal output section 14 to the common electrode 67. In synchronism with the switch 65, an output voltage VA or an output voltage VB is supplied to the pixel electrode 57 from the AC signal output section 14. Note that (i) the output voltage VA is supplied to the terminal 65*a* of the switch 65 and has a polarity identical with that of the output voltage Vcom and (ii) the output voltage VB is supplied to the terminal 65*b* of the switch 65 and is a reverse polarity of the output voltage Vcom. Also note that the output voltages Vcom, VA, and VB have identical cycles.

The pixel section switch element 61 has (i) a gate terminal connected with a scanning signal line $x_i$ (i=1, 2, . . . , and n (n is a positive integer)) and (ii) a source terminal connected with a data signal line $y_i$ (i=1, 2, . . . , and m (m is a positive integer)).

According to the configuration, a data signal (pixel value, voltage) supplied via the data signal line $y_i$ is latched by the digital memory element 68 while a scanning signal is being supplied to the scanning signal line $x_i$. The data signal thus latched is written into the liquid crystal cell 64 via the switch 65.

Specifically, in a case where a data signal supplied from the digital memory element 68 is at the High level, the switch 65 is controlled so that the terminal 65*a* is electrically connected with the pixel electrode 57. This causes (i) the data signal, which has been supplied from the digital memory element 68, to be written into the liquid crystal cell 64 via the switch 65 and (ii) an output voltage VA to be supplied to the liquid crystal cell 64 via the terminal 65*a*.

On the other hand, in a case where a data signal supplied from the digital memory element 68 is at the Low level, the switch 65 is controlled so that the terminal 65*b* is electrically connected with the pixel electrode 57. This causes (i) the data signal, which has been supplied from the digital memory element 68, to be written into the liquid crystal cell 64 via the switch 65 and (ii) an output voltage VB to be supplied to the liquid crystal cell 64 via the terminal 65*b*.

Then, while the signal supplied to the digital memory element 68 is being unchanged, an output voltage of the digital memory element 68 is held to be in a current state. As such, the output voltage of the digital memory element 68 is held even after a stoppage of supplying of signals to the data signal line $y_i$ and the scanning signal line $x_i$. This allows the liquid crystal panel 69 to keep displaying an image.

Note that the liquid crystal panel 69 can display an image only on a pixel group which is connected with a specified scanning signal line via which a scanning signal is to be supplied. Alternatively, the liquid crystal panel 69 can display an image only on a pixel group connected with a specified data signal line via which a data signal is to be supplied.

FIG. 3 is a circuit diagram illustrating a circuit configuration of a liquid crystal display device 1 which includes the liquid crystal panel 69 having the pixel memory.

Note that identical reference numerals shown in FIGS. 2 and 3 have identical configurations, regardless of their suffixes such as "i". For example, a pixel 60 and pixels $\mathbf{60}_{i(i+1)}$ through $\mathbf{60}_{(i+n)(i+m)}$ have identical configurations.

In the liquid crystal panel 69, pixels 60 (i.e., pixels $\mathbf{60}_{i(i+1)}$ and $\mathbf{60}_{(i+n)(i+m)}$) are arranged in a matrix manner, i.e., horizontally arranged m pixels×vertically arranged n pixels.

The liquid crystal display device 1 further includes a liquid crystal driver circuit 3 and an MPU (MicroProcessing Unit) 5 (see FIG. 3), in addition to the liquid crystal panel 69 illustrated in FIG. 2.

The MPU (image output requesting means) 5, which is a host computer, controls the entire liquid crystal display device 1. The liquid crystal driver circuit 3, which is an LSI, serves as a controller for the liquid crystal panel 69. The MPU 5 generates a command (hereinafter, referred to as "image transmission signal" (image output requesting signal)) requesting an image storing section 12 to supply image data, which is stored in the image storing section 12, to the liquid crystal panel 69. The MPU 5 then supplies a generated image output requesting signal to a control section 20 via an input section 11.

The liquid crystal driver circuit 3 includes a horizontal scanning line driver 70, a data line driver (image output means) 71, and a liquid crystal panel driving circuit (driving circuit) 10. The liquid crystal panel driving circuit 10 includes an AC signal output section (AC voltage output means) 14. Note that the liquid crystal panel driving circuit 10 will be described later in detail.

The liquid crystal driver circuit 3 is a circuit for driving and controlling the liquid crystal panel 69 to display an image. Each of the horizontal scanning line driver 70, the data line driver 71, and the AC signal output section 14 is connected with the pixels 60 in the liquid crystal panel 69.

The liquid crystal driver circuit 3 controls, while supplying a power supply voltage, (i) the horizontal scanning line driver 70 to output a scanning signal and (ii) the data line driver 71 to output a data signal so that pieces of image data of an image to be displayed on the liquid crystal panel 69 are written into the digital memory elements 68 and the liquid crystal cells 64 in the respective pixels 60.

The horizontal scanning line driver 70 specifies a scanning signal line $x_i$ with which writing target pixels are connected. The data line driver 71 supplies the data signal, which is to be written into a corresponding pixel, to a data signal line $y_i$. In other words, the data line driver 71 supplies image data, which is stored in the image storing section 12, to the liquid crystal panel 69.

The writing of image data into pixels 60 is carried out by repeatedly causing the liquid crystal panel driving circuit 10 to (i) supply, to the horizontal scanning line driver 70, a scanning signal for specifying a scanning line with which writing target pixels are connected and (ii) write, into the data line driver 71, data to be written into the writing target pixels.

(Output of Digital Memory Element and Input to Liquid Crystal Cell)

Figure 4:
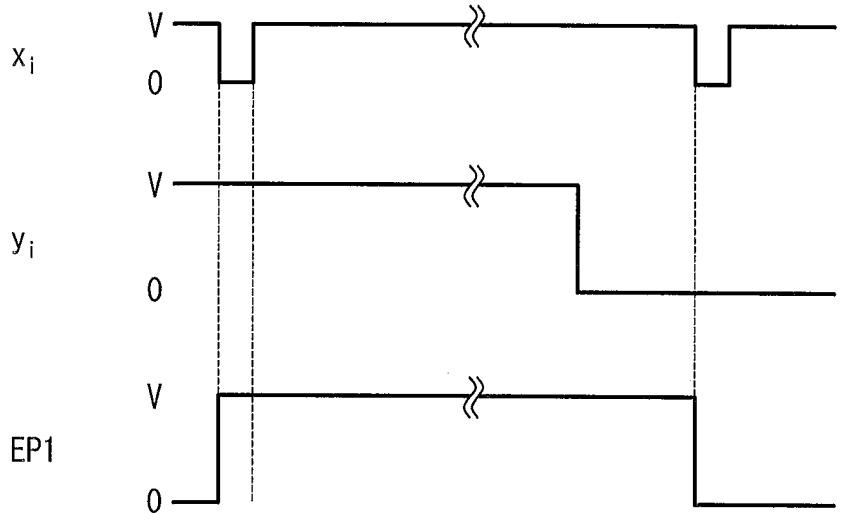
FIG. 4

The following description will discuss, with reference to FIGS. 2 through 4, a relation between a scanning signal and an output voltage EP1 of the digital memory element 68, which relation is obtained when a data signal supplied via a data signal line $y_i$ is latched by the digital memory element 68 when a signal line is specified in response to a scanning signal supplied via a scanning signal line $x_i$.

FIG. 4 illustrates a relation between a scanning signal and an output voltage EP1 of the digital memory element 68, which relation is obtained when a data signal supplied via the data signal line $y_i$ is latched by the digital memory element 68 when a signal line is specified in response to a scanning signal supplied via the scanning signal line $x_i$.

In a case where a scanning signal of a Low level (0) is supplied to the scanning signal line $x_i$ while a data signal of a High level (V) is being supplied to the data signal line $y_i$, an output voltage of the digital memory element 68 becomes a High level. Then, when the scanning signal is changed to a High level, the output voltage of the digital memory element 68 is fixed to the High level. The output voltage of the digital memory element 68 is held until the scanning signal becomes the Low level again.

The digital memory element 68 thus holds a current output voltage until the scanning signal, supplied via the scanning signal line $x_i$, becomes the Low level.

The following description will discuss a relation between an output voltage of the digital memory element 68 and an AC voltage applied across the liquid crystal cell 64, with reference to FIGS. 2, 3, and 5. Each of (a) and (b) of FIG. 5 illustrates an example relation between an output voltage of the digital memory element 68 and an AC voltage applied across the liquid crystal cell 64.

While the output voltage of the digital memory element 68 is being at the High level, the switch 65 maintains an electrical connection between the terminal 65*b* and the pixel electrode 57. This provides, as an output voltage of the switch 65, an output voltage VB which is a reverse polarity of an output voltage Vcom which is supplied to the common electrode 67. This causes a voltage EP2, which is a difference between the output voltage Vcom and the output voltage VB, to be applied across the liquid crystal cell 64 (see (a) of FIG. 5). The voltage EP2 constantly has a High level, and the constant voltage is applied across the liquid crystal cell 64. This causes the liquid crystal cell 64 to carry out a black display.

On the other hand, while the output of the digital memory element 68 is being at the Low level, the switch 65 maintains an electrical connection between the terminal 65*a* and the pixel electrode 57. This provides, as an output voltage of the switch 65, an output voltage VA whose polarity is identical with that of the output voltage Vcom. This causes a voltage EP3, which is a difference between the output voltage Vcom and the output voltage VA, to be applied across the liquid crystal cell 64 (see (b) of FIG. 5). The voltage EP3 constantly has a Low level, and therefore no voltage is applied to the liquid crystal cell 64. This causes the liquid crystal cell 64 to carry out a white display.

In a case where the liquid crystal panel 69 continuously displays a still image, it is not necessary to carry out switching with respect to the pixel section switch element 61 and the digital memory element 68. This allows the liquid crystal panel 69 to realize low electric power consumption.

Even in a case where the liquid crystal panel 69 continuously displays a still image, an AC voltage, which is applied across the liquid crystal cell 64 and whose polarity (the High or Low level) is reversed on a predetermined cycle, in accordance with the output voltage Vcom supplied from the AC signal output section 14. This makes it possible to prevent a reduction in reliability of the liquid crystal cell 64 of the liquid crystal panel 69, which reduction occurs, for example, in a case where a DC voltage is continuously being applied across the liquid crystal cell 64.

(Liquid Crystal Driver Circuit)

Figure 1:
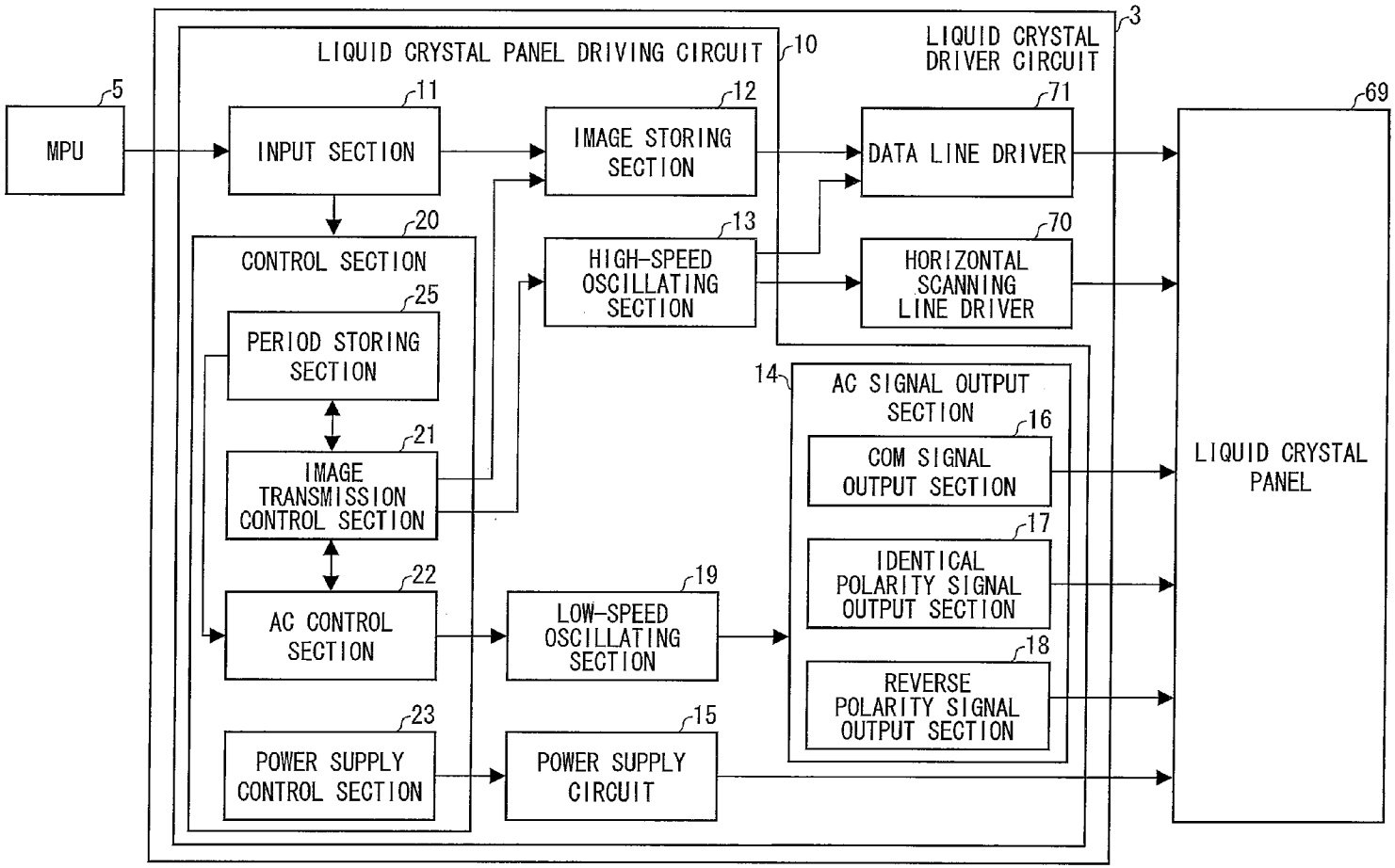
FIG. 1

The following description will discuss, in detail, a configuration of the liquid crystal panel driving circuit 10 in the liquid crystal display device 1, with reference to FIG. 1. FIG. 1 is a block diagram illustrating a configuration of the liquid crystal display device 1.

The liquid crystal panel driving circuit 10 controls the liquid crystal panel 69 by (i) issuing instructions on writing pieces of image data into respective pixels 60 of the liquid crystal panel 69 and (ii) supplying a power supply voltage to the liquid crystal panel 69.

The liquid crystal panel driving circuit 10 includes an input section 11, an image storing section (storing means) 12, a control section 20, a high-speed oscillating section (second oscillating means) 13, an AC signal output section (AC voltage output means) 14, a power supply circuit (booster circuit) 15, and a low-speed oscillating section (first oscillating means) 19.

The control section 20 includes an image transmission control section (image signal output instruction means) 21, an AC control section (polarity reversal instruction means) 22, a power supply control section 23, and a period storing section 25. The AC signal output section 14 includes a COM signal output section 16, an identical polarity signal output section 17, and a reverse polarity signal output section 18.

The input section 11 is an interface between the liquid crystal panel driving circuit 10 and the MPU 5. The input section 11 obtains image data from the MPU 5 and supplies obtained image data to the image storing section 12. When the input section 11 obtains, from the MPU 5, an image data transmission period, which is a time period required for transmitting image data to the liquid crystal panel 69, the input section 11 supplies an obtained image data transmission period to the period storing section 25.

When the input section 11 receives, from the MPU 5, a command (hereinafter, referred to as "image transmission signal") requesting a transmission of image data, the input section 11 supplies an obtained image transmission signal to the control section 20.

The image storing section 12 is a primary storage section for storing images and is realized by a storage device such as a RAM.

Image data, to be stored in the image storing section 12, is the one by which a still image is to be displayed in the pixels 60 of the liquid crystal panel 69. In the image storing section 12, image data supplied from the input section 11 is stored. Image data, which has been stored in the image storing section 12, is supplied to the data line driver 71 from the image storing section 12, in response to a signal indicative of an instruction on transmitting image data supplied from the image transmission control section 21.

The control section 20 is a logic circuit for controlling the entire liquid crystal driver circuit 3. The control section 20 (i) is connected with the high-speed oscillating section 13 and the low-speed oscillating section 19 and (ii) controls operations of the high-speed oscillating section 13 and the low-speed oscillating section 19. The control section 20 controls the high-speed oscillating section 13 and the low-speed oscillating section 19 to work with each other so that there occurs no polarity reversal of an AC voltage supplied to the liquid crystal panel 69, while image data is being transmitted to the liquid crystal panel 69.

In the period storing section 25, the following periods which have been calculated by the MPU 5 are stored: an image data transmission period, a polarity reversal waiting period, and a polarity reversal period (i.e., a time period during which a polarity of an AC voltage is being changed (reversed)). In the period storing section 25, an image data transmission period, a polarity reversal waiting period, and a polarity reversal period, the period storing section 25, which are supplied from the input section 11, are stored. Note that the image data transmission period, the polarity reversal waiting period, and the polarity reversal period will be described later in detail.

The image transmission control section 21 controls the image storing section 12 to supply image data, which is stored in the image storing section 12, to the liquid crystal panel 69 via the data line driver 71. The image transmission control section 21 further controls at least (i) supplying of an instruction to the high-speed oscillating section 13 and (ii) a frequency at which a clock signal is oscillated by the high-speed oscillating section 13. In other words, the image transmission control section 21 controls an operation of the high-speed oscillating section 13, so that image data, stored in the image storing section 12, is supplied to the liquid crystal panel 69.

Upon receipt of an image transmission signal from the MPU 5 via the input section 11, the image transmission control section 21 controls the supplying of image data to the liquid crystal panel 69.

Specifically, in response to an image transmission signal received via the input section 11, the image transmission control section 21 supplies, to the high-speed oscillating section 13, a signal indicative of an instruction on writing image data. This causes the image transmission control section 21 to control the operation of the high-speed oscillating section 13.

The image transmission control section 21 monitors a timing of polarity reversal of an AC voltage, which is applied across the liquid crystal cell 64, by monitoring an AC control section 22 which periodically controls the AC voltage. This will be described below.

The image transmission control section 21 determines, based on the image data transmission period and a cycle on which a COM reversal reference signal is outputted, whether or not the image data transmission period contains a period (i.e., polarity reversal period) during which a polarity reversal of a voltage, which is applied across the liquid crystal cell 64, is initiated in response to a polarity reversal of an AC voltage applied across the liquid crystal cell 64 and is then completed.

In a case where the image transmission control section determines that the image data transmission period contains the polarity reversal period, the image transmission control section 21 (i) instructs the image storing section 12 to output image data and (ii) supplies an instruction signal (hereinafter, referred to as "writing instruction signal") for causing the high-speed oscillating section 13 to carry out writing of the image data, after a polarity reversal of the voltage applied across the liquid crystal cell 64 has been completed.

In response to a writing instruction signal supplied from the image transmission control section 21, the high-speed oscillating section 13 generates (oscillates) a high-speed clock signal (second clock signal) and supplies, as a control signal for writing image data, the high-speed clock signals to the horizontal scanning line driver 70 and the data line driver 71.

Image data is written into a pixel 60 when a voltage is applied to the pixel 60, which voltage has a frequency higher than that of an AC voltage which is applied to the pixel 60 while being periodically subjected to a polarity reversal. As such, an oscillating clock signal generated by the high-speed oscillating section 13 has a frequency higher than that of an oscillating clock signal generated by the low-speed oscillating section 19.

According to the liquid crystal display device 1, the high-speed oscillating section 13 is operated only when image data, stored in the image storing section 12, is supplied to the liquid crystal panel 69. This allows a reduction in electric power consumption.

The AC control section 22 controls an operation of the low-speed oscillating section 19, so as to carry out a periodic polarity reversal of an AC voltage which is being applied to the liquid crystal cell 64. Alternatively, the AC control section 22 generates a COM reversal reference signal (reference signal) indicative of COM reversal reference points (reference time points) which periodically appear and at each of which the AC voltage, to be applied to the liquid crystal cell 64, is subjected to a polarity reversal. The AC control section 22 generates a polarity reversal signal indicative of polarity reversal time points (i) which periodically appear, (ii) which are delayed, by a predetermined time period, from the COM reversal reference points, and (iii) at each of which the AC voltage is subjected a polarity reversal. The AC control section 22 supplies the COM reversal reference signal or the polarity reversal signal to the low-speed oscillating section 19.

The low-speed oscillating section 19 is a circuit which generates a clock signal which oscillates at a speed slower than that generated by the high-speed oscillating section 13.

The low-speed oscillating section 19 generates a low-speed clock signal (first clock signal), which oscillates on a cycle indicated by a COM reversal reference signal or a polarity reversal signal supplied from the AC control section 22. The AC signal output section 14 is operated in response to the low-speed clock signal. Note that the low-speed oscillating section 19 constantly operates so that an AC voltage is applied across the liquid crystal cell 64.

The low-speed clock signal generated by the low-speed oscillating section 19 has a frequency lower than that of a high-speed clock signal generated by the high-speed oscillating section 13.

The AC signal output section 14 applies an AC voltage across the liquid crystal cell 64 of each of the pixels 60, while the AC voltage is being subjected to a polarity reversal on a cycle (at a frequency) of a low-speed clock signal supplied from the low-speed oscillating section 19.

In response to a low-speed clock signal supplied to the AC signal output section 14, the COM signal output section 16 (i) generates an output voltage Vcom in synchronism with a polarity of the low-speed clock signal and then (ii) supplies a generated output voltage Vcom to the common electrode 67 of the liquid crystal cell 64.

In response to a low-speed clock signal supplied to the AC signal output section 14, the identical polarity signal output section 17 (i) generates an output voltage VA, which is subjected to a polarity reversal so as to have an identical polarity of an output voltage Vcom, and then (ii) supplies a generated output voltage VA to the terminal 65*a* of the switch 65.

In response to a low-speed clock signal supplied to the AC signal output section 14, the reverse polarity signal output section 18 (i) generates an output voltage VB, which is subjected to a polarity reversal so as to have an reverse polarity of an output voltage Vcom, and then (ii) supplies a generated output voltage VB to the terminal 65*b* of the switch 65.

The power supply control section 23 controls an output of the power supply circuit (booster circuit) 15. The power supply circuit 15 supplies power to the liquid crystal panel 69 and also supplies a power supply voltage to circuits provided in the liquid crystal driver circuit 10, which is an LSI.

(Image Data Transmission Control)

The following description will discuss how to control a timing at which image data is transmitted, with reference to FIGS. 1, 6, and 7.

FIG. 6 illustrates a period during which image data is being transmitted (i.e., image data transmission period).

The image data transmission period (image transmission period) (i) starts at a time point at which an image data transmission request is issued by the MPU 5 and (ii) ends at a time point at which a change is completed in electric potentials of respective of a digital memory element 68 and a liquid crystal cell 64 of a pixel 60, into which the image data, transmitted to the liquid crystal panel 69 from the image storing section 12, is to be written (i.e., ends at a time point at which scanning is completed).

In other words, the image data transmission period is a period (scanning) which (i) starts at a time point when the image data is supplied to the liquid crystal panel 69 and (ii) ends at a time point when a change is completed in electric potentials held by respective digital memory elements 68 which are changed in respective pixels 60.

In a case where, for example, image data stored in the image storing section 12 needs to be written into all the pixels 60, the image data transmission period is a period from start of the writing of image data to completion of the writing of image data into all the pixels $\mathbf{60}_{ii}$ through $\mathbf{60}_{(i+n)(i+m)}$.

The image data transmission period is calculated by the MPU 5. Specifically, the image data transmission period is calculated based on (i) a resolution of the liquid crystal panel 69 and (ii) a time period between (a) a time point when outputs of the data line driver 71 and the horizontal scanning line driver 70 are made and (b) a time point when scanning of all the pixels 60 in the liquid crystal panel 69 is completed.

In the present embodiment, the image data transmission period is a TT time.

FIG. 7 illustrates a relation between (i) a COM voltage which has been applied across the liquid crystal cell 64 and (ii) an image data transmission period. The COM voltage is an AC voltage, applied across the liquid crystal cell 64, which is obtained by the liquid crystal cell 64 being charged in response to an output voltage Vcom and an output voltage VA or VB. That is, the COM voltage is an AC voltage component of a voltage applied across the liquid crystal cell 64.

The AC control section 22 sets COM reversal reference points (reference times), each serving as a reference that causes a polarity reversal of an AC voltage, so as to appear on a given cycle T.

The AC control section 22 generates a polarity reversal signal which indicates periodic polarity reversal time points each of which is delayed, by a predetermined time period (period TT), from a corresponding one of the COM reversal reference points each of which is a reference time point for reversing the polarity of the AC voltage. In synchronism with the periodic polarity reversal time points, the AC voltage, which is supplied from the AC signal output section 14, is subjected to a polarity reversal.

For example, it is assumed that an output voltage Vcom (COM voltage), which is an AC voltage, is subjected to a polarity reversal at each time point which is delayed, by a period TT, from a corresponding COM reversal reference point. A predetermined time period from a COM reversal reference point, during which a polarity reversal of the output voltage Vcom is not carried out (enter a wait state), is referred to as "polarity reversal waiting period". In the present embodiment, an image data transmission period is used as a polarity reversal waiting period. The polarity reversal waiting period is equal to a distance between (i) a cycle of COM reversal reference points and (ii) a cycle of polarity reversal time points.

A time period, during which an output voltage Vcom (COM voltage) is subjected to a polarity reversal from a Low level to a High level or vice versa, is referred to as "polarity reversal period".

The polarity reversal period is a period which (i) starts at a time point when a polarity reversal starts in synchronism with a polarity reversal of an AC voltage applied across the liquid crystal cell 64 and (ii) ends at a time point when the polarity reversal is completed.

Here, (i) a polarity reversal waiting period of the output voltage Vcom is assumed to be a period TT, as with the image data transmission period and (ii) a polarity reversal period of the output voltage Vcom is assumed to be a period TT1.

A polarity reversal of the COM voltage to a Low level is completed at a time point T0, which is a COM reversal reference point. Subsequently, the polarity (i.e., the Low level) of the COM voltage is maintained for the period TT. The polarity reversal waiting period is equivalent to the period TT between (i) the time point T0 (=0), which is the COM reversal reference point and (ii) a time point TT which is a reference point A.

The polarity reversal waiting period is thus secured so as to be equal to the image data transmission period. As such, even if an image data transmission request is issued from the MPU 5 before the COM reversal reference point (time point T0), then it is possible to surely prevent the output voltage Vcom from being subjected to a polarity reversal during the image data transmission period.

After the period TT has elapsed since the time point T0, the liquid crystal capacitor (liquid crystal 64*a*) starts to be charged at the time point TT (i.e., the reference point A). This causes the output voltage Vcom to start to be subjected to a polarity reversal from the Low level to the High level. Then, the polarity reversal to the High level is completed at a time point (TT+TT1), which is a reference point B at which a period TT1 has elapsed since the time point TT. The polarity reversal period is equal to the period TT1 between the time point TT (reference point A) and the time point (TT+TT1) (reference point B).

A transmission waiting period, which starts from the COM reversal reference point and during which issuance of an image data transmission instruction is delayed, is equivalent to a sum total of the polarity reversal waiting period (period TT) and the polarity reversal period (period TT1).

After a time period T (next COM reversal reference point) has elapsed since the time point (T0), the polarity of the output voltage Vcom is maintained for a further period TT, which is equivalent to the polarity reversal waiting period. At a time point (T+TT) which is equivalent to a reference point D, a polarity reversal of the output voltage Vcom starts from the High level to the Low level. Then, the polarity reversal to the Low level is completed at a time point (T+TT+TT1), which is equivalent to a reference point E at which a period TT1 has elapsed since the time point (T+TT). From this, the period TT1 between the reference point D and the reference point E is a polarity reversal period. Moreover, a period between the COM reversal reference point (time point T) and the reference point E (time point T+TT+TT1) is equivalent to a transmission waiting period.

The polarity of the COM voltage is thus changed (reversed).

Specifically, in a case where an image data transmission period TT is, for example, 16.6 ms (60 Hz), a polarity reversal period TT1 is calculated to be approximately 100 μs and a cycle T of COM reversals is calculated to be approximately one (1) second, based on factors such as a capacitance of the liquid crystal cell 64.

In a case where, for example, the image transmission control section 21 of the control section 20 receives an image data transmission request from the MPU 5 at a time point S (between the time point T0 (i.e., COM reversal reference point) and the time point (TT+TT1) (i.e., reference point B)), a polarity reversal period (between the time point TT and the time point (TT+TT1)) of the output voltage Vcom is contained in a period (S+TT), which is obtained by adding a period TT (image data transmission period) to the period S.

In other words, if image data is transmitted during a transmission waiting period, then the COM voltage will be subjected to a polarity reversal while the image data is being transmitted.

Specifically, in a case where TT=16.6 ms, TT1=100 μs (0.1 ms), and a cycle T=1 second (1000 ms), a probability that the COM voltage will be subjected to a polarity reversal during the image data transmission period is approximately 16.7/1000. Even such a probability causes an increase in possibility that the image data will be transmitted while the COM voltage is being subjected to a polarity reversal, in a case where transmission of image data is repeatedly carried out while the display device is being used over a long time period.

In view of the circumstances, even in a case where the image transmission control section 21 receives an image data transmission request during a transmission waiting period, the image transmission control section 21 does not immediately (i) instruct the image storing section 12 to transmit image data and (ii) supply a writing instruction signal to the high-speed oscillating section 13.

Instead, the image transmission control section 21 (i) instructs the image storing section 12 to transmit image data and (ii) supplies a writing instruction signal to the high-speed oscillating section 13, after a transmission waiting period has elapsed since a COM reversal reference point.

Specifically, in a case where the image transmission control section 21 receives an image data transmission request from the MPU 5, the image transmission control section 21 determines whether or not a time point at which the image transmission control section 21 received the image data transmission request falls within a time range (period) from (i) a COM reversal reference point (time point T0, time point T) to (ii) a time point equivalent to a sum total of a polarity reversal waiting period (period TT) and a polarity reversal period (period TT1). In a case where the time point falls within the time range, the image transmission control section 21 (i) instructs the image storing section 12 to transmit image data and (ii) supplies a writing instruction signal to the high-speed oscillating section 13, after the sum total of the polarity reversal waiting period (period TT) and the polarity reversal period (period TT1) has elapsed since the COM reversal reference point (time point T0, time point T).

This makes it possible to prevent the COM voltage from being subjected to a polarity reversal during an image data transmission period. As such, it is possible to prevent an electric potential, which is held by the digital memory element 68, from changing abnormally. This allows prevention of a deterioration in quality of a displayed image.

Note that a polarity reversal waiting period is not necessarily limited to a period which has elapsed since a COM reversal reference point (time point T0), provided that the polarity reversal waiting period is calculated on the basis of the COM reversal reference point. The polarity reversal waiting period can be, for example, a period between (i) a time period (time point T0−TT) which comes, by an image data transmission period, before the COM reversal reference point (time point T0) and (ii) the COM reversal reference point (time point T0). In this case, a period TT1 starting at the COM reversal reference point (time point T0) is a polarity reversal period.

Also note that the polarity reversal waiting period can be an image data transmission period as above described or can be longer than the image data transmission period. This makes it possible to surely prevent, during an image data transmission period, a polarity reversal of a COM voltage in the liquid crystal cell 64 caused by a polarity reversal of AC voltage, provided that the COM reversal reference point is identified. In a case where the polarity reversal waiting period is longer than the image data transmission period, it is possible to surely prevent the AC voltage from being subjected to a polarity reversal during the image data transmission period.

By thus securing a polarity reversal waiting period, it is possible to adjust a period between a COM reversal reference point and a time point (time point TT+TT1, T+TT+TT1) at which a polarity reversal of a COM voltage is completed in response to a polarity reversal signal. It is therefore possible to prevent an AC voltage from being subjected to a polarity reversal during an image data transmission period.

Note that it is preferable that a time period during which a High level voltage is being applied across the liquid crystal cell 64 is identical with a time period during which a Low level voltage is being applied across the liquid crystal cell 64. This makes it possible to suppress a decrease in reliability of liquid crystal. In other words, it is preferable that an AC voltage whose duty ratio is 50% is applied across the liquid crystal cell 64 for a polarity reversal of the COM voltage.

The "duty ratio" means a ratio of time period, with respect to an AC voltage is being applied across the liquid crystal cell 64, during which a High level voltage is being applied across the liquid crystal cell 64 per unit time. That is, the "duty of 50%" indicates a ratio per cycle of an output voltage Vcom, at which ratio the High level voltage is being applied.

As early described, according to the liquid crystal display device 1 of the present embodiment, a COM voltage can be periodically subjected to a polarity reversal. Specifically, a High level voltage and a Low level voltage are alternated in the output voltage Vcom, each of which voltages is applied for a time period (T−(TT+TT1)) every other cycle (i.e., per time period T). By thus setting the duty ratio to 50% in advance, it is possible to (i) constantly maintain the duty ratio of 50% thus set and (ii) prevent the output voltage Vcom (i.e., COM voltage) from being subjected to a polarity reversal during an image transmission period.

On the other hand, there can be a method, other than the method of the present embodiment, in which, for example, an image data transmission is prioritized for preventing an image data transmission period from containing a timing at which an AC voltage is subjected to a polarity reversal. In other words, a method can be conceived in which a timing is delayed at which the AC voltage is subjected to the polarity reversal during the image data transmission period.

However, an image data transmission request is made by a user, etc. at an arbitrary timing. Under the circumstances, in a case where, for example, a user consecutively makes image data transmission requests, the timing at which the AC voltage is subjected to the polarity reversal is delayed frequently. If such a state continues, the AC voltage continuously fails to maintain a duty ratio of 50%, and therefore reliability of a liquid crystal cell will be decreased.

Unlike such a configuration, the liquid crystal display device 1 of the present embodiment can prevent (i) a decrease in reliability of liquid crystal and (ii) a deterioration in display quality.

(Process Flow)

The following description will discuss a flow of processes carried out in the liquid crystal display device 1, with reference to FIG. 8.

FIG. 8 is a flowchart illustrating a flow of processes carried out in the liquid crystal display device 1.

The MPU 5 first issues, as a command (resolution setting signal), information indicative of a resolution of the liquid crystal panel 69 so that the control section 20 is set in accordance with the resolution of the liquid crystal panel 69. The MPU 5 then supplies the resolution setting signal to the control section 20 via the input section 11. This causes the control section 20 to be set in accordance with the resolution of the liquid crystal panel 69.

The AC control section 22 generates a COM reversal reference signal indicative of COM reversal reference points appearing on a given cycle on each of which the AC voltage is subjected to a polarity reversal. Until a polarity reversal waiting period is stored in the period storing section 25, the AC control section 22 keeps supplying, to the low-speed oscillating section 19, the COM reversal reference signal as a polarity reversal signal indicating a given cycle on which the AC voltage is subjected to a polarity reversal.

The low-speed oscillating section 19 generates, on the given cycle indicated by the polarity reversal signal received from the AC control section 22, a low-speed clock signal (first clock) for causing the AC signal output section 14 to operate. The low-speed oscillating section 19 then supplies a generated low-speed clock signal to the AC signal output section 14. The AC signal output section 14 (i) reverses the polarity of the AC voltage at a constant clock of the low-speed clock signal and (ii) supplies the AC voltage to the liquid crystal cell 64.

As such, the AC voltage, which is applied across the liquid crystal cell 64, is subjected to a polarity reversal on a given cycle caused by the AC control section 22.

The MPU 5 calculates an image data transmission period from the resolution of the liquid crystal panel 69. Here, it is assumed that the image data transmission period is a period TT and the image data transmission period is used as a polarity reversal waiting period of an output voltage Vcom. The MPU 5 sets a polarity reversal period of the output voltage Vcom based on information of the liquid crystal panel 69. Here, the polarity reversal period is set to a period TT1.

The MPU 5 supplies a calculated image data transmission period to the input section 11. The input section 11 supplies, to the period storing section 25, the image data transmission period and the polarity reversal period, which have been received from the MPU 5. Then, the image data transmission period (polarity reversal waiting period) and the polarity reversal period, which have been received from the input section 11, are stored in the period storing section 25 (step S10).

A sum total of the polarity reversal waiting period and the polarity reversal period, which are stored in the period storing section 25, is equivalent to a transmission waiting period.

When the polarity reversal waiting period is stored in the period storing section 25, the AC control section 22 generates a polarity reversal signal indicative of polarity reversal time points appearing on a given cycle, which polarity reversal time points are delayed, by a predetermined time period, from the respective COM reversal reference points. Then, the AC control section 22 supplies a generated polarity reversal signal to the low-speed oscillating section 19.

That is, the AC control section 22 controls the low-speed oscillating section 19, which is outputting clock signals on a given cycle, to output a clock signal which is delayed in phase that corresponds to the polarity reversal waiting period. As such, the low-speed oscillating section 19 generates a low-speed clock signal, whose phase is delayed from the COM reversal reference point by the polarity reversal waiting period (i.e., a period between the COM reversal reference point and the reference point A shown in FIG. 7), so that the AC signal output section 14 causes the AC voltage to be subjected to a polarity reversal in response to the low-speed clock signal.

Then, the MPU 5 supplies, to the input section 11, image data of an image to be displayed on the liquid crystal panel 69. Upon receipt of image data from the MPU 5, the input section 11 supplies the image data to the image storing section 12. Then, the image data which has been obtained from the input section 11 is stored in the image storing section 12 (step S11).

Then, the MPU 5 generates, at an arbitrary timing (i.e., a time point S), an image transmission signal indicative of an image data transmission request. The image transmission signal thus generated is supplied to the input section 11. Then, the input section 11 supplies the image transmission signal to the control section 20.

Then, the image transmission control section 21 obtains the image transmission signal received by the control section 20 (step S12).

Then, the image transmission control section 21, which is monitoring a cycle on which the AC voltage, supplied from the AC control section 22, is subjected to a polarity reversal, determines whether or not the time point S is contained in an image data transmission waiting period (period TT+TT1), based on a COM reversal reference point (time point T0) controlled by the AC control section 22 (step S13).

In other words, the image transmission control section 21 determines whether or not an image data transmission period contains a period during which a polarity reversal of a voltage, which is applied across the liquid crystal cell 64, is initiated in response to a polarity reversal of the AC voltage applied across the liquid crystal cell 64 and is then completed.

The image transmission control section 21 can thus determine, based on the time point S at which the image transmission signal has been generated by the MPU 5, whether or not the voltage applied across the liquid crystal cell 64 is subjected to a polarity reversal during the image data transmission period.

In a case where the image transmission control section 21 determines that the time point S is contained in the transmission waiting period (period TT+TT1) (YES in step S13), the image transmission control section 21 waits for an end of the transmission waiting period (period TT+TT1).

Whereas, in a case where the image transmission control section 21 determines that the time point S is not contained in the transmission waiting period (period TT+TT1) (NO in step S13), the image transmission control section 21 (i) issues an instruction on outputting image data (step S14) and (ii) supplies a writing instruction signal to the high-speed oscillating section 13.

Upon receipt of the instruction on outputting image data from the image transmission control section 21, the image storing section 12 supplies image data, which is stored in the image storing section 12, to the data line driver 71 of the liquid crystal panel 69.

Upon receipt of the writing instruction signal from the image transmission control section 21, the high-speed oscillating section 13 generates a high-speed clock signal, which oscillates at a frequency higher than that of a low-speed clock signal generated by the low-speed oscillating section 19, so that the data line driver 71 and the horizontal scanning line driver 70 are operated. Then, the high-speed oscillating section 13 supplies, to the horizontal scanning line driver 70 and the data line driver 71, the high-speed clock signals as a writing control signal which is an image data transmission signal.

Then, pieces of image data are sequentially written into appropriate pixels 60 (digital memory elements 68 and liquid crystal cells 64) by (i) the data line driver 71 which has received the image data and the writing control signal and (ii) the horizontal scanning line driver 70 which has received the writing control signal. Specifically, electric potentials held by the respective digital memory element 68 and electric potentials supplied to the respective liquid crystal cells 64 are changed in accordance with an image to be displayed. The image data is thus transmitted to the liquid crystal panel 69 (step S18).

As above described, in a case where the image transmission control section 21 determines that a period, during which the voltage applied across the liquid crystal cell 64 is being subjected to a polarity reversal in response to a polarity reversal of an AC voltage applied across the liquid crystal cell 64, is contained in an image data transmission period during which a polarity reversal of a voltage, which is supplied from the digital memory element 68 to the liquid crystal cell 64, (i) is initiated in response to image data being supplied to the liquid crystal panel 69 and (ii) is then completed, the image transmission control section 21 issues an instruction on outputting image data to the liquid crystal panel 69 after the polarity reversal of the voltage applied across the liquid crystal cell 64 is completed.

This makes it possible to prevent the AC voltage, which is applied across the liquid crystal cell 64, from being subjected to a polarity reversal during the image data transmission period. As such, it is possible to prevent an electric potential, which is held by the digital memory element 68, from changing abnormally. This allows prevention of a deterioration in quality of a displayed image.

(Program and Storage Medium)

Each block of the liquid crystal display device 1, in particular, the control section 20, the MPU 5, the high-speed oscillating section 13, and the low-speed oscillating section may be configured by hardware logic or realized by software with the use of a computer as follows.

That is, the liquid crystal display device 1 includes a CPU (central processing unit), a ROM (read only memory), a RAM (random access memory), and a storage device (storage medium) such as a memory. The CPU executes instructions of control programs for realizing the functions of the control section 20, the MPU 5, the high-speed oscillating section 13, and the low-speed oscillating section 19. In the ROM, the programs are stored. Into the RAM, the programs are loaded. In the storage device, the programs and various data are stored. The objective of the present invention can also be achieved, by (i) supplying a storage medium, in which program codes (executable programs, intermediate code programs, source programs) of programs for controlling the control section 20, the MPU 5, the high-speed oscillating section 13, and the low-speed oscillating section 19, each being configured by software for realizing the functions, are stored so that a computer can read them, to the control section 20, the MPU 5, the high-speed oscillating section 13, and the low-speed oscillating section 19, and then (ii) causing the computer (or CPU or MPU) to read and execute the program codes stored in the storage medium.

The storage medium can be, for example, a tape, such as a magnetic tape or a cassette tape; a disk including (i) a magnetic disk such as a floppy (Registered Trademark) disk or a hard disk and (ii) an optical disk such as CD-ROM, MO, MD, DVD, or CD-R; a card such as an IC card (memory card) or an optical card; or a semiconductor memory such as a mask ROM, EPROM, EEPROM, or flash ROM.

Alternatively, the control section 20, the MPU 5, the high-speed oscillating section 13, and the low-speed oscillating section 19 can be arranged to be connected to a communications network so that the program codes are delivered over the communications network. The communications network is not limited to a specific one, and therefore can be, for example, the Internet, an intranet, extranet, LAN, ISDN, VAN, CATV communications network, virtual private network, telephone line network, mobile communications network, or satellite communications network. The transfer medium which constitutes the communications network is not limited to a specific one, and therefore can be, for example, wired line such as IEEE 1394, USB, electric power line, cable TV line, telephone line, or ADSL line; or wireless such as infrared radiation (IrDA, remote control), Bluetooth (Registered Trademark), 802.11 wireless, HDR, mobile telephone network, satellite line, or terrestrial digital network. Note that, the present invention can be realized by a computer data signal (i) which is realized by electronic transmission of the program code and (ii) which is embedded in a carrier wave.

As above described, the liquid crystal display device of the present invention includes: a liquid crystal panel in which a plurality of pixels for displaying an image are arranged; and a driving circuit for supplying an image signal to the liquid crystal panel so that the liquid crystal panel displays the image, each of the plurality of pixels having: a storage element for holding an electric potential which varies depending on an image signal supplied from the driving circuit, and a display element to which a voltage for displaying the image is applied by the electric potential being supplied to the display element, the driving circuit including: polarity reversal instruction means for causing an AC voltage, which is applied across the display element, to be subjected to a polarity reversal, and image signal output instruction means for issuing an instruction on supplying the image signal to the liquid crystal panel, in a case where the image signal output instruction means determines that a polarity reversal period is contained in an image transmission period, the image signal output instruction means carries out the instruction on supplying the image signal to the liquid crystal panel after a polarity reversal of the voltage is completed, during the image transmission period, a change in the voltage, which is supplied from the storage element to the display element, (i) being initiated in response to the image signal being supplied to the liquid crystal panel and (ii) being then completed, during the polarity reversal period, the voltage applied across the display element being subjected to a polarity reversal in response to a polarity reversal of the AC voltage.

In order to attain the object, the display method of the present invention includes a driving method, in which driving method a liquid crystal panel displays an image by supplying an image signal to the liquid crystal panel in which a plurality of pixels for displaying the image are arranged, each of the plurality of pixels having: a storage element for holding an electric potential which varies depending on an image signal supplied from the driving circuit, and a display element to which a voltage for displaying the image is applied by the electric potential being supplied to the display element, the display method including the steps of: (i) causing an AC voltage, which is applied across the display element, to be subjected to a polarity reversal, and (ii) issuing an instruction on supplying the image signal to the liquid crystal panel, in a case where it is determined, in the step (ii), that a polarity reversal period is contained in an image transmission period, the instruction on supplying the image signal to the liquid crystal panel is carried out after a polarity reversal of the voltage is completed, during the image transmission period, a change in the voltage, which is supplied from the storage element to the display element, (a) being initiated in response to the image signal being supplied to the liquid crystal panel and (b) being then completed, during the polarity reversal period, the voltage applied across the display element being subjected to a polarity reversal in response to a polarity reversal of the AC voltage.

According to the configuration, each of the plurality of pixels has (i) the storage element for holding an electric potential which varies depending on an image signal supplied from the driving circuit and (ii) the display element to which the voltage for displaying the image is applied by the electric potential being supplied to the display element. With the configuration, in a case where an identical image is displayed, it is not necessary to renew the electric potential held by the storage element. Hence, in a case where the identical image is continuously displayed, the liquid crystal panel does not need to read another image signal. This allows a reduction in electric power consumed by the liquid crystal panel.

Moreover, according to the configuration, the polarity reversal instruction means causes the AC voltage, which is applied across the display element, to be subjected to a polarity reversal on a given cycle. This makes it possible to (i) prevent a DC voltage from being applied across the display element and (ii) prevent a decrease in reliability of the display element.

Moreover, according to the configuration, in a case where the image signal output instruction means determines that the polarity reversal period, during which the voltage applied across the display element is being subjected to the polarity reversal in response to the polarity reversal of the AC voltage, is contained in the image transmission period during which a polarity reversal of the voltage, which is supplied from the storage element to the display element, (i) is initiated in response to the image signal being supplied to the liquid crystal panel and (ii) is then completed, the image signal output instruction means carries out the instruction on supplying the image signal to the liquid crystal panel after the polarity reversal of the voltage is completed.

This makes it possible to prevent the AC voltage, applied to the display element, from being subjected to a polarity reversal during the image transmission period. As such, it is possible to prevent an electric potential, which is held by the storage element of each of the plurality of pixels, from changing abnormally. This allows prevention of a deterioration in quality of a displayed image.

It is preferable that the driving circuit further includes storing means for storing the image signal; the image signal output instruction means instructs the storing means to output the image signal; and upon receipt of an instruction on outputting the image signal from the image signal output instruction means, the storing means supplies the image signal, which is stored in the storing means, to the liquid crystal panel.

According to the configuration, the image signal output instruction means can cause the image signal, which is stored in the storing means, to be supplied to the liquid crystal panel. With the configuration, the driving circuit does not need to read an image signal from outside of the driving circuit for updating an image displayed on the liquid crystal panel. This makes it possible to quickly update the image displayed on the liquid crystal panel.

It is preferable that the polarity reversal instruction means generates a polarity reversal signal indicative of a given cycle on which the AC voltage is subjected to the polarity reversal, the liquid crystal display device further including: AC voltage output means for (i) causing an AC voltage to be subjected to a polarity reversal on a given cycle and (ii) supplying the AC voltage to the display element.

According to the configuration, the AC voltage output means (i) causes the polarity of the AC voltage to be subjected to the polarity reversal on the given cycle set by the polarity reversal instruction means and (ii) supplies the AC voltage to the display element. This makes it possible to cause the AC voltage, which is applied to the display element, to be subjected to a polarity reversal on the given cycle set by the polarity reversal instruction means.

It is preferable that the polarity reversal instruction means generates a reference signal indicative of reference time points appearing on a first cycle, at each of the reference time points the AC voltage being subjected to a polarity reversal; and the polarity reversal signal is indicative of polarity reversal time points which (i) are delayed from the respective reference time points by a predetermined time period and (ii) appear on a second cycle.

With the configuration, it is possible to adjust a period (i) which starts from the reference time point and (ii) which ends when a polarity reversal of the display element, caused in response to the polarity reversal signal, is completed. This makes it possible to prevent the AC voltage from being subjected to a polarity reversal during the image transmission period.

It is preferable that a polarity reversal waiting period, which is equal to a distance between the first and second cycles, is equal to or longer than the image transmission period.

According to the configuration, a period between (i) the reference time point and (ii) a time point at which the polarity reversal of the AC voltage starts is longer than the image transmission period. It is therefore possible to prevent the AC voltage from being subjected to a polarity reversal during the image transmission period, by merely specifying the reference time point.

It is preferable that the liquid crystal display device further includes image output requesting means for generating an image output requesting signal for requesting the image signal output instruction means to issue an instruction on supplying the image signal, which is stored in the storing means, to the liquid crystal panel, upon receipt of the image output requesting signal from the image output requesting means, the image signal output instruction means issuing an instruction on supplying an image signal to the liquid crystal panel.

According to the configuration, the image signal output instruction means issues, in response to the image output requesting signal from the image output requesting means, an instruction on outputting an image signal to the liquid crystal panel. This causes the image signal to be outputted to the liquid crystal panel.

It is preferable that the image signal output instruction means determines whether or not the AC voltage, which is applied across the display element, is subjected to a polarity reversal during the image transmission period, by determining whether or not a time point, at which the image output requesting means generated an image output requesting signal, is contained in a sum total of (i) a period from a reference time point, at which the AC voltage is subjected to a polarity reversal, until a polarity reversal time point delayed from the reference time point by the predetermined time period and (ii) a period until the polarity reversal of the display element is completed, which polarity reversal is caused in response to the polarity reversal of the AC voltage caused by the AC voltage output means.

According to the configuration, the image signal output instruction means determines, based on the time point at which the image output requesting means generated the image output requesting signal, whether or not the voltage applied across the display element is subjected to a polarity reversal, during the image transmission period, by the polarity reversal of the AC voltage applied to the display element.

It is preferable that the liquid crystal display device further includes: first oscillating means for outputting a first clock signal for causing the AC voltage output means to operate; image output means for causing an image signal, which is stored in the storing means, to be supplied to the liquid crystal panel; and second oscillating means for outputting a second clock signal for causing the image output means to operate, a frequency of the first clock signal being lower than that of the second clock signal.

In general, outputting of a low frequency consumes electric power less than outputting of a high frequency.

According to the configuration of the present invention, when an image signal stored in the storing section is supplied to the liquid crystal panel, the first oscillating means is operated to output the first clock signal whose frequency is higher than that of the second clock signal. On the other hand, the second oscillating means, which needs to be constantly operated to supply the AC voltage to the display element, outputs the second clock signal whose frequency is lower than that of the first clock signal. This causes the AC voltage output means to operate.

According to the configuration, the first oscillating means is operated to output the first clock signal, whose frequency is higher than that of the second clock signal, only when the image signal stored in the storing section is supplied to the liquid crystal panel. This makes it possible to reduce electric power consumption.

Note that the above means of the liquid crystal display device can be realized by a computer. In such a case, the present invention encompasses (i) a display program which causes the computer to serve as each of the means of the liquid crystal display device and (ii) a computer-readable storage medium in which the display program is stored.

The present invention is not limited to the embodiments, but can be altered by a skilled person in the art within the scope of the claims. An embodiment derived from a proper combination of technical means disclosed in respective different embodiments is also encompassed in the technical scope of the present invention.

INDUSTRIAL APPLICABILITY

According to the present invention, it is possible to (i) prevent a decrease in reliability of liquid crystal, (ii) update, without rewriting data, an image to be displayed, and (iii) prevent a deterioration in quality of a displayed image. The present invention is therefore suitably applicable to a liquid crystal display device for displaying an image.

REFERENCE SIGNS LIST

1 Liquid crystal display device
3 Liquid crystal driver circuit
5 MPU (image output requesting means)
10 Liquid crystal panel driving circuit (driving circuit)
11 Input section
12 Image storing section (storing means)
13 High-speed oscillating section (second oscillating means)
14 AC signal output section (AC voltage output means)
15 Power supply circuit
16 COM signal output section
17 Identical polarity signal output section
18 Reverse polarity signal output section
19 Low-speed oscillating section (first oscillating means)
20 Control section
21 Image transmission control section (image signal output instruction means)
22 AC control section (polarity reversal instruction means)
23 Power supply control section
25 Period storing section
60 Pixel
61 Pixel section switch element
64 Liquid crystal cell (display element)
57 Pixel electrode
67 Common electrode
68 Digital memory element (storage element)
69 Liquid crystal panel
70 Horizontal scanning line driver
71 Data line driver (image output means)

The invention claimed is:

1. A liquid crystal display device, comprising:

a liquid crystal panel in which a plurality of pixels for displaying an image are arranged; and a driving circuit configured to supply an image signal to the liquid crystal panel so that the liquid crystal panel displays the image, each of the plurality of pixels including:

a storage element configured to store an electric potential which varies depending on an image signal supplied from the driving circuit, and a display element to which a voltage for displaying the image is applied by the electric potential being supplied to the display element, the driving circuit including:

a polarity reversal instruction section configured to cause an AC voltage, which is applied across the display element, to be subjected to a polarity reversal, an image signal output instruction section configured to issue an instruction on supplying the image signal to the liquid crystal panel, and an image signal storage configured to store the image signal, wherein in a case where the image signal output instruction section determines that a polarity reversal period is contained in an image transmission period, the image signal output instruction section carries out the instruction on supplying the image signal to the liquid crystal panel after a polarity reversal of the voltage is completed, during the image transmission period, a change in the voltage, which is supplied from the storage element to the display element, (i) is initiated in response to the image signal being supplied to the liquid crystal panel and (ii) is then completed, during the polarity reversal period, the voltage applied across the display element is subjected to a polarity reversal in response to a polarity reversal of the AC voltage, the image signal output instruction section instructs the image signal storage to output the image signal, upon receipt of an instruction on outputting the image signal from the image signal output instruction section, the image signal storage supplies the image signal, which is stored in the image signal storage, to the liquid crystal panel, the polarity reversal instruction section generates a polarity reversal signal indicative of a given cycle on which the AC voltage is subjected to the polarity reversal, the liquid crystal display device further comprises an AC voltage output section configured to (i) cause an AC voltage to be subjected to a polarity reversal on a given cycle and (ii) supply the AC voltage to the display element, the polarity reversal instruction section generates a reference signal indicative of reference time points appearing on a first cycle, at each of the reference time points the AC voltage being subjected to a polarity reversal; and the polarity reversal signal is indicative of polarity reversal time points which (i) are delayed from the respective reference time points by a predetermined time period and (ii) appear on a second cycle.

2. The liquid crystal display device as set forth in claim 1, wherein:

a polarity reversal waiting period, which is equal to a distance between the first and second cycles, is equal to or longer than the image transmission period.

3. A liquid crystal display device as set forth in claim 1, further comprising:

a first oscillating section configured to output a first clock signal to cause the AC voltage output section to operate;

an image output section configured to cause an image signal, which is stored in the image signal storage, to be supplied to the liquid crystal panel; and a second oscillating section configured to output a second clock signal for causing the image output section to operate, a frequency of the first clock signal being lower than that of the second clock signal.

4. A liquid crystal display device, comprising:

a liquid crystal panel in which a plurality of pixels for displaying an image are arranged; and a driving circuit configured to supply an image signal to the liquid crystal panel so that the liquid crystal panel displays the image, each of the plurality of pixels including:

a storage element configured to store an electric potential which varies depending on an image signal supplied from the driving circuit, and a display element to which a voltage for displaying the image is applied by the electric potential being supplied to the display element, the driving circuit including:

a polarity reversal instruction section configured to cause an AC voltage, which is applied across the display element, to be subjected to a polarity reversal, an image signal output instruction section configured to issue an instruction on supplying the image signal to the liquid crystal panel, and an image signal storage configured to store the image signal, wherein in a case where the image signal output instruction section determines that a polarity reversal period is contained in an image transmission period, the image signal output instruction section carries out the instruction on supplying the image signal to the liquid crystal panel after a polarity reversal of the voltage is completed, during the image transmission period, a change in the voltage, which is supplied from the storage element to the display element, (i) is initiated in response to the image signal being supplied to the liquid crystal panel and (ii) is then completed, during the polarity reversal period, the voltage applied across the display element is subjected to a polarity reversal in response to a polarity reversal of the AC voltage, the image signal output instruction section instructs the image signal storage to output the image signal, upon receipt of the image output requesting signal from the image output requesting section, the image signal output instruction section issues an instruction on supplying an image signal to the liquid crystal panel, the polarity reversal instruction section generates a polarity reversal signal indicative of a given cycle on which the AC voltage is subjected to the polarity reversal, the liquid crystal display device further comprises an AC voltage output section configured to (i) cause an AC voltage to be subjected to a polarity reversal on a given cycle and (ii) supply the AC voltage to the display element, the liquid crystal display device further comprises an image output requesting section configured to generate an image output requesting signal to request the image signal output instruction section to issue the instruction on supplying the image signal, which is stored in the image signal storage, to the liquid crystal panel, upon receipt of the instruction on outputting the image signal from the image signal output instruction section, the image signal storage supplies the image signal, which is stored in the image signal storage, to the liquid crystal panel, and the image signal output instruction section determines whether or not the AC voltage, which is applied across the display element, is subjected to a polarity reversal during the image transmission period, by determining whether or not a time point, at which the image output requesting section generated an image output requesting signal, is contained in a sum total of (i) a period from a reference time point, at which the AC voltage is subjected to a polarity reversal, until a polarity reversal time point delayed from the reference time point by the predetermined time period and (ii) a period until the polarity reversal of the display element is completed, which polarity reversal is caused in response to the polarity reversal of the AC voltage caused by the AC voltage output section.

* * * * *